US006805106B2

(12) United States Patent
Kumagai et al.

(10) Patent No.: US 6,805,106 B2
(45) Date of Patent: Oct. 19, 2004

(54) FUEL-INJECTION SYSTEM

(75) Inventors: Masato Kumagai, Saitama (JP); Hiroshi Yamada, Gunma (JP); Kazuyoshi Mori, Gunma (JP)

(73) Assignee: Unisia Jecs Corporation, Kanagawa (JP)

( * ) Notice: Subject to any disclaimer, the term of this patent is extended or adjusted under 35 U.S.C. 154(b) by 1 day.

(21) Appl. No.: 10/210,045

(22) Filed: Aug. 2, 2002

(65) Prior Publication Data

US 2003/0041842 A1 Mar. 6, 2003

(30) Foreign Application Priority Data

Sep. 5, 2001 (JP) ..... 2001-269191

(51) Int. Cl.[7] ..... F02M 37/04
(52) U.S. Cl. ..... 123/514; 123/456
(58) Field of Search ..... 123/514, 456, 123/179.17, 516, 463, 467, 497

(56) References Cited

U.S. PATENT DOCUMENTS 3,949,713 A * 4/1976 Rivere ..... 123/458
5,207,203 A * 5/1993 Wagner et al. ..... 123/514
5,425,342 A * 6/1995 Ariga et al. ..... 123/456
5,572,974 A * 11/1996 Wakeman ..... 123/497
5,749,345 A * 5/1998 Treml ..... 123/456
6,024,064 A * 2/2000 Kato et al. ..... 123/179.17
6,223,725 B1 * 5/2001 Onishi et al. ..... 123/447
6,234,151 B1 * 5/2001 Eck ..... 123/514
6,321,727 B1 * 11/2001 Reddy et al. ..... 123/520

* cited by examiner

*Primary Examiner*—Carl S. Miller
(74) *Attorney, Agent, or Firm*—Sughrue Mion, PLLC

(57) ABSTRACT

In a fuel-injection system with a pressure regulator disposed in the middle of a fuel supply line and located upstream of a fuel injector for regulating the pressure of fuel flowing through the fuel supply line and for returning surplus fuel via the pressure regulator into a fuel tank, a reflux pipe arrangement is located downstream of the fuel injector and connected at one end to the downstream end of the fuel supply line and connected at the other end to the fuel tank. A reflux control device is disposed in the middle of the reflux pipe arrangement for controlling a flow rate of the fuel flowing through the reflux pipe arrangement. The reflux control device is comprised of a reflux control valve or a fluid-flow restriction orifice member.

8 Claims, 8 Drawing Sheets

FUEL-INJECTION SYSTEM

TECHNICAL FIELD

The present invention relates to a fuel-injection system for an automotive fuel-injected engine that fuel is injected into a combustion chamber via a fuel injector.

BACKGROUND ART

Generally, there are two types of electronic fuel-injection systems mounted on automotive vehicles, namely a so-called non-return system (see FIG. 7) and a so-called full-return system (see FIG. 8). The non-return system shown in FIG. 7 includes at least a fuel tank 1, a fuel pump 3, a fuel supply line 5, fuel injectors 10, an upstream pressure regulator 11, and a fuel return line 12. For instance, in a four-wheeled vehicle, tank 1 is usually mounted at the rear of the vehicle and has a fuel storage capacity of several tens of liters. Tank 1 is constructed as a sealed fuel tank. Pump 3 is provided in the interior or exterior space of tank 1. Pump 3 is generally comprised of an electric fuel pump that is driven by an electric motor. Pump 3 is provided for inducting fuel 2 stored in tank 1 and for discharging pressurized fuel toward the upstream side of supply line 5. The non-return system of FIG. 7 is exemplified in a four-cylinder fuel-injected engine that has four fuel injectors 10 on each cylinder of an internal combustion engine 4 to deliver fuel 2 to each of four combustion chambers. Supply line 5 is provided for supplying fuel 2 to the respective injectors. Supply line 5 includes a feed pipe 6 extending from the front end of the vehicle to the rear end, fuel distributor pipes 7 and 8, and a connecting pipe 9 intercommunicating two distributor pipes 7 and 8. Feed pipe 6 is connected to the discharge outlet of pump 3 to supply fuel 2 to the respective fuel distributor pipes 7 and 8. Distributor pipes 7 and 8 are made of a metal pipe material having a substantially cylindrical shape and located near the combustion chambers so that distributor pipes 7 and 8 extend straight along the respective sidewall surfaces of engine 4. In the non-return system of FIG. 7, the pressurized fuel from pump 3 is discharged into the upstream side of feed pipe 6 and delivered into upstream pressure regulator 11 that prevents excessive pressure from developing and regulates the output pressure from upstream pressure regulator 11 to a predetermined pressure, for example, a pressure level ranging from 250 to 350 kPa. First, the fuel regulated by upstream pressure regulator 11 is supplied into the first distributor pipe 7 of distributor pipes 7 and 8. Then, the regulated fuel is further delivered via connecting pipe 9 to the second distributor pipe 8. The downstream end 8A of second distributor pipe 8 is formed as a dead end of supply line 5. As shown in FIG. 7, a first group of injectors 10, 10 are integrally connected to first distributor pipe 7, whereas a second group of injectors 10, 10 are integrally connected to second distributor pipe 8. In the system shown in FIG. 7, the four fuel injectors and distributor pipes 7 and 8 construct a so-called "gallery-type" fuel-pipe integrated fuel injection unit. An electromagnetic actuator (electromagnetic solenoid) is built within the injector body and is responsive to a control signal from an electronic engine control unit (ECU) to control both opening and closing of each fuel injector 10. When the actuator is energized and thus the injector valve of each fuel injector 10 opens, the fuel within distributor pipes 7 and 8 is sprayed or injected into the combustion chamber. The amount of fuel injected is controlled by a fuel-injection signal from the ECU. Generally, a pulsewidth modulated control signal or a duty-cycle modulated pulsewidth signal is used as the fuel-injection signal. Upstream pressure regulator 11 is disposed in a middle of feed pipe 6 of supply line 5 and includes an inflow conduit portion 11A, an outflow conduit portion 11B, and a return conduit portion 11C. Return conduit portion 11C is connected to return line 12 that is connected to tank 1. Upstream pressure regulator 11 uses intake manifold pressure (manifold vacuum) as a control pressure. Surplus fuel is returned through return line 12 to tank 1, after pressure-regulating action of upstream pressure regulator 11. As clearly seen in FIG. 7, an installation position of upstream pressure regulator 11 is spaced apart from engine 4. For instance, upstream pressure regulator 11 is mounted on a floor panel corresponding to the bottom portion of the engine room in order to suppress heat from being transferred from engine 4 to return line 12. Although it is not shown in FIG. 7, a fuel filter is disposed in feed pipe 6 and located between the discharge port of pump 3 and the pressure-regulator inflow conduit portion 11A to remove any impurities from the fuel flowing through feed pipe 6. According to the non-return system shown in FIG. 7, when pump 3 is activated and thus fuel 2 stored in tank 1 is discharged into feed pipe 6 of supply line 5, a portion of fuel discharged from pump 3 flows from the pressure-regulator inflow conduit portion 11A to the pressure-regulator outflow conduit portion 11B (see the fuel flow indicated by the arrow A) and is delivered into distributor pipes 7 and 8 located downstream of the pressure-regulator outflow conduit portion 11B. In this manner, a portion of fuel flowing through distributor pipes 7 and 8 and having the fuel-injection pressure controlled by upstream pressure regulator 11 can be injected through each fuel injector 10 into the combustion chamber. As indicated by the arrow B in FIG. 7, as a result of fuel-pressure regulating action of upstream pressure regulator 11, as the surplus fuel, most of the fuel discharged from pump 3 returns through the pressure-regulator return conduit portion 11C via return line 12 to tank 1, without flowing through distributor pipes 7 and 8.

On the other hand, in the full-return system shown in FIG. 8, one end of a fuel return line 13 is connected to the downstream end 8A of supply line 5, whereas the other end of return line 13 is connected to tank 1. A downstream pressure regulator 14 is disposed in a middle of return line 13. As seen in FIG. 8, downstream pressure regulator 14 includes an inflow conduit portion 14A that is connected to the downstream end 8A of second distributor pipe 8 via the upstream portion of return line 13, and a return conduit portion 14B that is connected to tank 1 via the downstream portion of return line 13. Downstream pressure regulator 14 functions to return the surplus fuel through the pressure-regulator return conduit portion 14B to tank 1 (see the return flow indicated by the arrow C in FIG. 8), while regulating the fuel passing through distributor pipes 7 and 8 and returning into return line 13 to the predetermined pressure level (250–350 kPa). According to the full-return system shown in FIG. 8, when pump 3 is activated and thus fuel 2 stored in tank 1 is discharged into feed pipe 6 of supply line 5, all the fuel discharged from pump 3 is delivered into first distributor pipe 7 (see the fuel flow indicated by the arrow A in FIG. 8). In this manner, a portion of fuel flowing through distributor pipes 7 and 8 and having the fuel-injection pressure controlled by downstream pressure regulator 14 can be injected through each fuel injector 10 into the combustion chamber. As indicated by the arrow C in FIG. 8, as a result of fuel-pressure regulating action of downstream pressure regulator 14, as the surplus fuel, most of the fuel discharged from pump 3 passes through distributor pipes 7 and 8 and thereafter consecutively returns via the pressure-regulator return conduit portion 14B and return line 13 to tank 1. In case of the full-return system of FIG. 8, the surplus fuel has to pass through distributor pipes 7 and 8. Heat is undesirably transferred from engine 4 to the surplus fuel passing through distributor pipes 7 and 8. That is, the high-temperature surplus fuel returns through downstream pressure regulator 14 and return line 13 to tank 1. Under a particular condition that a residual quantity of fuel in tank 1 is very little, a temperature in the fuel stored in tank 1 tends to rise owing to the high-temperature surplus fuel. The temperature rise causes the fuel to expand and to vaporize more readily, and thus the amount of generation of fuel vapor (evaporation gas) created in tank 1 tends to increase. This results in unstable fuel-injection amount control.

SUMMARY OF THE INVENTION

The non-return system of FIG. 7 has the following drawback. The downstream end 8A of second distributor pipe 8 is formed as a dead end of supply line 5, and therefore fuel vapor tends to be created within distributor pipes 7 and 8. There is a possibility that the fuel vapor prevailing in distributor pies 7 and 8 is injected from the injector valve together with fuel delivered into the fuel injector. As a result of this, an air/fuel mixture ratio (A/F) tends to change to an undesirably leaner mixture ratio. In particular, when restarting the engine under a condition wherein the engine has already been warmed up, during engine hot restart, there is an increased tendency for a restartability of the engine to be lowered owing to fuel vapors created within distributor pipes 7 and 8.

On the other hand, the full-return system of FIG. 8 has the following merit and demerit. The surplus fuel consecutively returns through the pressure-regulator return conduit portion 14B and return line 13 to tank 1 and therefore fuel vapors created within distributor pipes 7 and 8 can be carried into tank 1 together with the fuel flow from second distributor pipe via downstream pressure regulator 14 to tank 1. However, in the full-return system of FIG. 8, there is a problem of fuel vapors created owing to a temperature rise in the surplus fuel flowing through distributor pipes 7 and 8.

Accordingly, it is an object of the invention to provide a fuel-injection system, which is capable of enhancing an engine restartability by way of reduced fuel vapors and ensuring stable fuel-injection amount control by way of reduced evaporation gases created in a fuel tank.

In order to accomplish the aforementioned and other objects of the present invention, a fuel-injection system comprises a fuel tank storing fuel, a fuel injector injecting the fuel, a fuel pump inducting the fuel from the fuel tank and discharging pressurized fuel into a fuel supply line that is connected one end to the fuel pump and connected at the other end to the fuel injector, a pressure regulator disposed in a middle of the fuel supply line and located upstream of the fuel injector for regulating a pressure of the fuel flowing through the fuel supply line and for returning surplus fuel via the pressure regulator into the fuel tank, a reflux pipe arrangement that is located downstream of the fuel injector and connected at one end to a downstream end of the fuel supply line and connected at the other end to the fuel tank, and a reflux control device disposed in a middle of the reflux pipe arrangement for controlling a flow rate of the fuel flowing through the reflux pipe arrangement.

According to another aspect of the invention, a fuel-injection system comprises a fuel tank storing fuel, a fuel injector injecting the fuel, a fuel pump inducting the fuel from the fuel tank and discharging pressurized fuel into a fuel supply line that is connected one end to the fuel pump and connected at the other end to the fuel injector, a pressure regulator disposed in a middle of the fuel supply line and located upstream of the fuel injector for regulating a pressure of the fuel flowing through the fuel supply line and for returning surplus fuel via the pressure regulator into the fuel tank, a reflux pipe arrangement that is located downstream of the fuel injector and connected at one end to a downstream end of the fuel supply line, the other end of the reflux pipe arrangement extending toward the fuel tank, and a reflux control valve disposed in a middle of the reflux pipe arrangement for selectively establishing and blocking fluid communication between the reflux pipe arrangement and the fuel tank.

According to a further aspect of the invention, a fuel-injection system comprises a fuel tank storing fuel, a fuel injector injecting the fuel, a fuel pump inducting the fuel from the fuel tank and discharging pressurized fuel into a fuel supply line that is connected one end to the fuel pump and connected at the other end to the fuel injector, a pressure regulator disposed in a middle of the fuel supply line and located upstream of the fuel injector for regulating a pressure of the fuel flowing through the fuel supply line and for returning surplus fuel via the pressure regulator into the fuel tank, a reflux pipe arrangement that is located downstream of the fuel injector and connected at one end to a downstream end of the fuel supply line, the other end of the reflux pipe arrangement extending toward the fuel tank, and an orifice member constructed integral with the pressure regulator and disposed in a middle of the reflux pipe arrangement for restricting a flow rate of the fuel flowing through the reflux pipe arrangement.

According to a still further aspect of the invention, a fuel-injection system for an internal combustion engine comprises a sealed fuel tank storing fuel, a fuel injector injecting the fuel, a fuel pump inducting the fuel from the fuel tank and discharging pressurized fuel into a fuel supply line that is connected one end to the fuel pump and connected at the other end to the fuel injector, the fuel supply line comprising a distributor pipe located near combustion chambers of the engine and a feed pipe extending from the fuel pump to distributor pipe, a pressure regulator disposed in a middle of the feed pipe and located upstream of the fuel injector for regulating a pressure of the fuel flowing through the fuel supply line and for returning surplus fuel via the pressure regulator into the fuel tank without flowing through the distributor pipe, a reflux pipe arrangement that is located downstream of the fuel injector and connected at one end to a downstream end of the distributor pipe and connected at the other end to the fuel tank, and a reflux control device disposed in a middle of the reflux pipe arrangement for controlling a flow rate of the fuel flowing through the reflux pipe arrangement.

According to another aspect of the invention, a fuel-injection system for an internal combustion engine comprises a sealed fuel tank storing fuel, a fuel injector injecting the fuel, a fuel pump inducting the fuel from the fuel tank and discharging pressurized fuel into a fuel supply line that is connected one end to the fuel pump and connected at the other end to the fuel injector, the fuel supply line comprising a distributor pipe located near combustion chambers of the engine and a feed pipe extending from the fuel pump to distributor pipe, a pressure regulator disposed in a middle of the feed pipe and located upstream of the fuel injector for regulating a pressure of the fuel flowing through the fuel supply line and for returning surplus fuel via the pressure regulator into the fuel tank without flowing through the distributor pipe, a reflux pipe arrangement that is located downstream of the fuel injector and connected at one end to a downstream end of the distributor pipe and connected at the other end to the fuel tank, and a reflux control valve disposed in a middle of the reflux pipe arrangement for selectively establishing and blocking fluid communication between the reflux pipe arrangement and the fuel tank.

According to another aspect of the invention, a fuel-injection system for an internal combustion engine comprises a sealed fuel tank storing fuel, a fuel injector injecting the fuel, a fuel pump inducting the fuel from the fuel tank and discharging pressurized fuel into a fuel supply line that is connected one end to the fuel pump and connected at the other end to the fuel injector, the fuel supply line comprising a distributor pipe located near combustion chambers of the engine and a feed pipe extending from the fuel pump to distributor pipe, a pressure regulator disposed in a middle of the feed pipe and located upstream of the fuel injector for regulating a pressure of the fuel flowing through the fuel supply line and for returning surplus fuel via the pressure regulator into the fuel tank without flowing through the distributor pipe, a reflux pipe arrangement that is located downstream of the fuel injector and connected at one end to a downstream end of the distributor pipe and connected at the other end to the fuel tank, and an orifice member constructed integral with the pressure regulator and disposed in a middle of the reflux pipe arrangement for restricting a flow rate of the fuel flowing through the reflux pipe arrangement.

The other objects and features of this invention will become understood from the following description with reference to the accompanying drawings.

DESCRIPTION OF THE PREFERRED EMBODIMENTS

Figure 1:
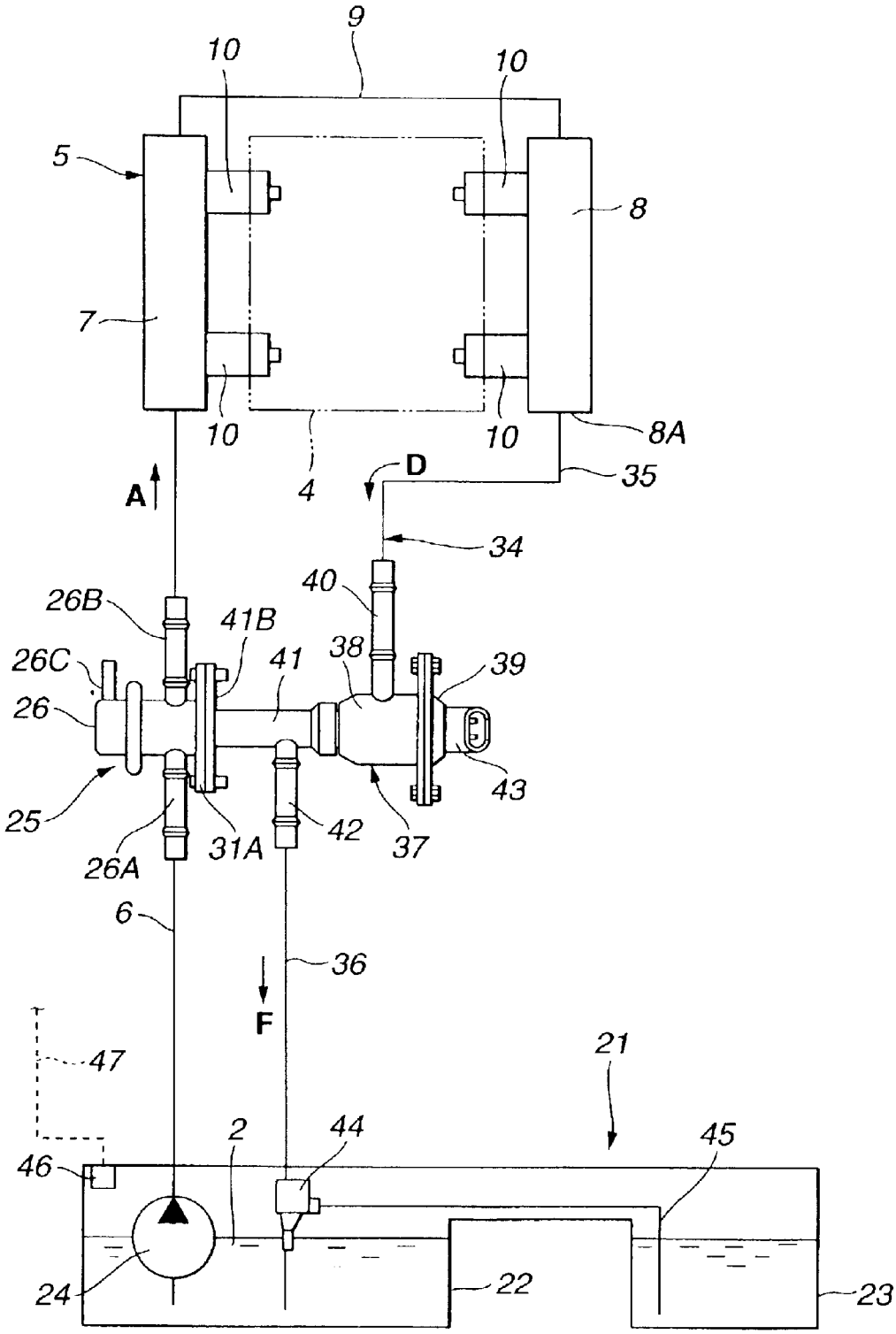
FIG. 1 is a fuel-injection system component layout of a first embodiment.
Figure 2:
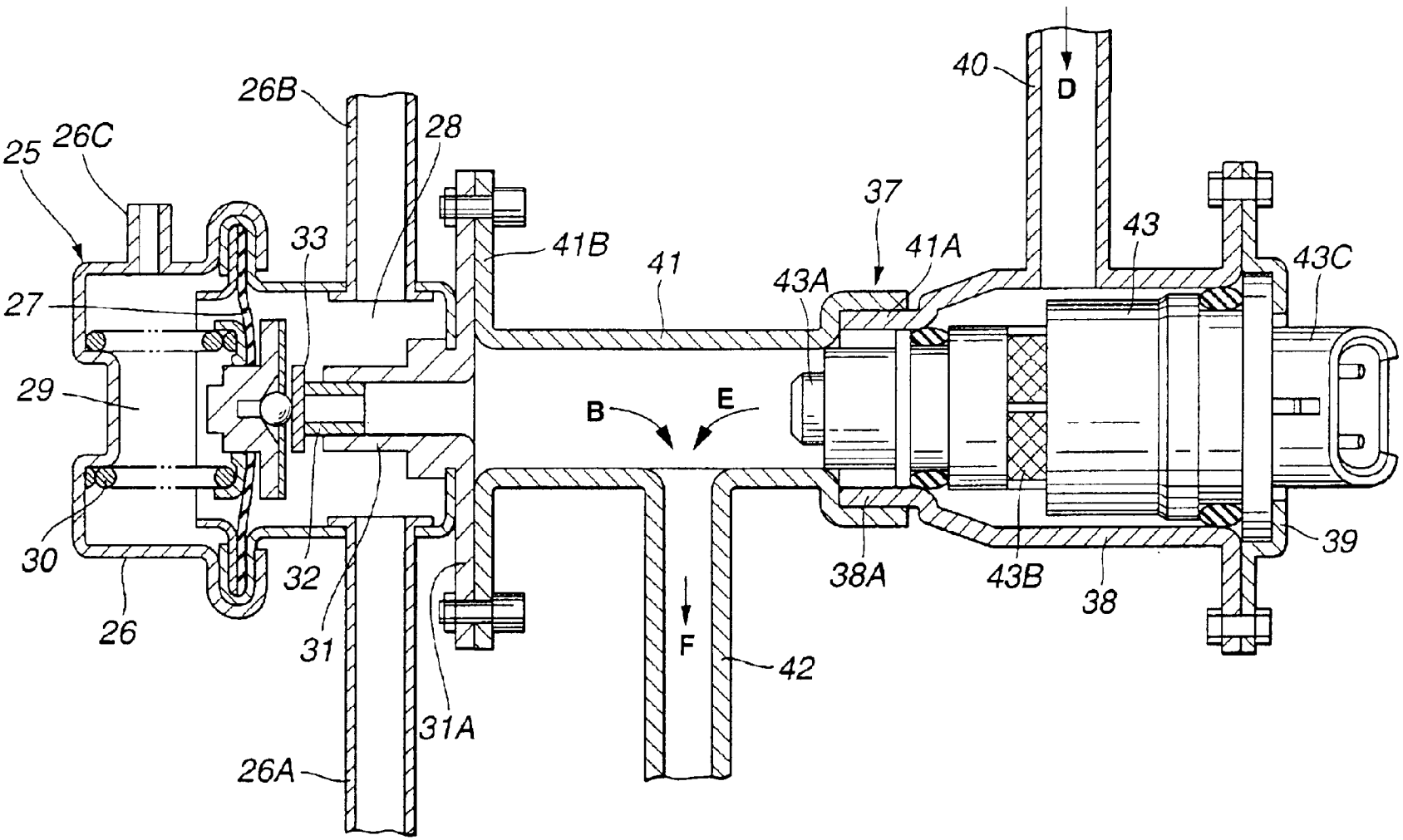
FIG. 2 is an enlarged longitudinal cross-sectional view illustrating a pressure regulator and a valve assembly incorporated in the system of the first embodiment shown in FIG. 1.

Referring now to the drawings, particularly to FIGS. 1 and 2, the fuel-injection system of the first embodiment is exemplified in a four-cylinder fuel-injected internal combustion engine. For the purpose of comparison among the non-return system shown in FIG. 7, the full-return system shown in FIG. 8, and the systems of the first, second, third, and fourth embodiments, the same reference signs used to designate elements shown in the non-return system shown in FIG. 7 (or the full-return system shown in FIG. 8) will be applied to the corresponding elements shown in each system of the first, second, third, and fourth embodiments. In the system of the first embodiment of FIG. 1, a fuel tank 21 is comprised of a main-tank portion 22 and a sub-tank portion 23 communicated with each other. Tank 21 is constructed as a sealed fuel tank. That is, fuel 2 is stored in both main-tank portion and sub-tank portion. The fuel stored in sub-tank portion 23 is inducted toward main-tank portion 22 by means of a jet pump 44. A fuel pump 24 is similar to fuel pump 3 shown in FIGS. 7 and 8. Pump 24 functions to pressurize the fuel from main-tank portion 22 and to discharge the pressurized fuel into feed pipe 6. Pump 24 incorporated in the system of the first embodiment is constructed as an in-oil type pump bracketed in main-tank portion 22 of fuel tank 21. A pressure regulator 25 is disposed in a middle of feed pipe 6 of supply line 5. As can be appreciated from comparison between pressure regulator 25 of FIG. 1 and pressure regulator 11 of FIG. 7, pressure regulator 25 of FIG. 1 is similar to pressure regulator 11 of FIG. 7 in construction. In the first embodiment, as an integrated valve unit, pressure regulator 25 and a reflux control valve 43 (described later) are united together or integrated with each other by integrally connecting pressure regulator 25 to a valve assembly 37 (which will be fully described later) that accommodates therein reflux control valve 43. More concretely, pressure regulator 25 is comprised of a regulator casing 26, a diaphragm 27, a pressure-regulator relief-pressure spring (or a diaphragm spring) 30, a fuel return conduit portion 31, a cylindrical-hollow valve seat 32, and a valve portion 33. As best seen in FIG. 2, an internal space of casing 26 is divided into a fuel chamber 28 and a control pressure chamber 29 by diaphragm 27. Casing 26 is integrally formed with an inflow conduit portion 26A and an outflow conduit portion 26B diametrically opposed to each other with respect to the central axis of the substantially cylindrical pressure-regulator casing and communicating fuel chamber 28. In flow conduit portion 26A is connected via a portion of feed pipe 6 to pump 24, whereas outflow conduit portion 26B is connected via a portion of feed pipe 6 to first distributor pipe 7. A part of casing 26 defining control pressure chamber 29 is formed integral with a control pressure induction tube portion 26C. Control pressure induction tube portion 26C is connected via an air induction conduit (not shown) to an intake manifold of engine 4 so as to introduce manifold vacuum into control pressure chamber 29. The pressure of fuel in fuel chamber 28 is variably controlled by way of introduction of manifold vacuum serving as a control pressure for pressure regulator 25. Diaphragm spring 30 is operably disposed in control pressure chamber 29 in such a manner as to permanently force valve portion 33 toward the cylindrical-hollow valve seat 32 via diaphragm 27. As appreciated, a set pressure of pressure regulator 25 is determined depending on an initial value of the spring bias of diaphragm spring 30 or a preload of spring 30. In the system of the shown embodiment, the set pressure of pressure regulator 25 is set to a predetermined pressure, for example a pressure level ranging from 250 to 350 kPa. A part denoted by reference sign 31 is a fuel return conduit portion fixed to pressure-regulator casing 26. One end of return conduit portion 31, that is, a stepped axially-extending cylindrical portion, protrudes into fuel chamber 28 and extends to the vicinity of valve portion 33. The aforementioned cylindrical-hollow valve seat 32 is fitted to the inner periphery of the stepped axially-extending cylindrical portion of return conduit portion 31. The other end of return conduit portion 31 is formed with a radially-extending flange 31A located in the exterior space of casing 26. Flange 31A of return conduit portion 31 is fitted to a radially-extending flange 41B of a connecting tube portion 41 (described later) in a fluid-tight fashion by way of fastening means such as bolts and nuts, such that return conduit portion 31 is communicated with tank 21 through connecting tube portion 41 and a junction tube portion 42 (described later) to return the surplus fuel from fuel chamber 28 to tank 21. The previously-discussed valve portion 33 is attached to the central portion of diaphragm 27 in such a manner as to be able to axially move due to deformation of diaphragm 27. In more detail, the degree of deformation of diaphragm 27 is determined depending on both the spring bias of diaphragm spring 30 and the manifold vacuum applied to one side of diaphragm 27 facing control pressure chamber 29. When the vacuum in control pressure chamber 29 is built up and as a result diaphragm 27 deforms in one axial direction (in the leftward direction in FIG. 2) against the diaphragm spring bias, valve portion 33 is lifted from its valve seat 32 to establish fluid-communication between fuel chamber 28 and return conduit portion 31. Conversely when the vacuum in control pressure chamber 29 is reduced and as a result diaphragm 27 deforms in the other axial direction (in the rightward direction in FIG. 2) by virtue of the diaphragm spring bias, valve portion 33 is re-seated on its valve seat 32 to block fluid-communication between fuel chamber 28 and return conduit portion 31. In this manner, pressure regulator 25 regulates the pressure of fuel flowing from inflow conduit portion 26A to outflow conduit portion 26B by lifting and reseating valve portion 33 from and on valve seat 32. As a result of fuel-pressure regulating action of pressure regulator 25, the surplus fuel returns through the connecting tube portion 41, junction tube portion 42, and a connection pipe 36 (described later) to tank 21. For instance, pressure regulator 25 is detachably mounted on a floor panel (not shown) corresponding to the bottom portion of the engine room and located near a bulkhead through which the engine room and the vehicle compartment are divided. As clearly shown in FIG. 1, a return line denoted by reference sign 34 is a reflux pipe arrangement. Reflux pipe arrangement 34 includes two connecting pipes 35 and 36. One end of first connecting pipe 35 is connected to the downstream end 8A of supply line 5, whereas the other end of first connecting pipe 35 is connected to an inflow conduit portion 40 of valve assembly 37. One end of second connecting pipe 36 is connected to junction tube portion 42, whereas the other end of second connecting pipe 36 is connected to main-tank portion 22 of fuel tank 21. First connecting pipe 35 is laid out in the engine room in a manner so as to extend from the downstream end 8A of second distributor pipe 8 to inflow conduit portion 40 of valve assembly 37. Second connecting pipe 36 is arranged in a manner so as to extend from junction tube portion 42 of valve assembly 37 to tank 21 located at the rear end of the vehicle.

As can be seen from FIGS. 1 and 2, valve assembly 37 functions as a pipe-connecting member and also constructs a part of reflux pipe arrangement 34. As best seen in FIG. 2, valve assembly 37 includes a cylindrical valve casing 38, a cover 39, inflow conduit portion 40, connecting tube portion 41, and junction tube portion 42. A reflux control valve 43 is operatively accommodated in valve casing 38. Cover 39 hermetically seals one end of valve casing 38 under a condition that reflux control valve 43 is installed in valve casing 38. Inflow conduit portion 40 extends in the radial direction of cylindrical valve casing 38 and communicates with the inflow side of reflux control valve 43. The other end of valve casing 38, which faces apart from cover 39 in the axial direction, is formed as a diametrically-diminished cylindrical portion 38A. A diametrically-enlarged cylindrical portion 41A of connecting tube portion 41 is fitted onto the outer periphery of diametrically-diminished cylindrical portion 38A in a fluid-tight fashion. Actually, diametrically-enlarged cylindrical portion 41A of connecting tube portion 41 is fixedly connected to the outer periphery of diametrically-diminished cylindrical portion 38A by way of welding or blazing. An injection nozzle portion 43A of reflux control valve 43 is fitted into diametrically-diminished cylindrical portion 38A of valve casing 38. A seal ring such as an O ring is disposed between the outer periphery of injection nozzle portion 43A and the inner periphery of diametrically-diminished cylindrical portion 38A so as to provide tight seal. Connecting tube portion 41 constructs a part of valve assembly 37. Connecting tube portion 41 is made of a metal pipe material having a substantially cylindrical shape. One end (i.e., diametrically-enlarged cylindrical portion 41A) of connecting tube portion 41 is fixedly connected and fitted to diametrically-diminished cylindrical portion 38A of valve casing 38. Connecting tube portion 41 is formed at the other end with radially-extending flange 41B. Valve assembly 37 is integrally connected to pressure regulator 25 by fitting flange 31A of return conduit portion 31 of pressure regulator 25 to flange 41B of connecting tube portion 41 by means of fastening means for example bolts and nuts. Injection nozzle portion 43A of reflux control valve 43 is communicated with return conduit portion 31 of pressure regulator 25 by connecting return conduit portion 31 of pressure regulator 25 to valve casing 38 of valve assembly 37 via connecting tube portion 41.

Junction tube portion 42 extends radially outwards from the substantially midpoint of connecting tube portion 41. Junction tube portion 42 serves to connect connecting tube portion 41 via connecting pipe 36 to tank 21. Junction tube portion 42 also serves as a confluent point between the surplus fuel flow consecutively returning from pressure-regulator return conduit portion 31 toward second connecting pipe (downstream connecting pipe) 36 of reflux pipe arrangement 34 and the fuel flow returned via reflux control valve 43 toward tank 21. In a similar manner to fuel injector 10, reflux control valve 43 is also comprised of an electromagnetic valve. As clearly shown in FIG. 2, one axial end (the left-hand end) of reflux control valve 43 is formed as the injection nozzle portion 43A (the outflow portion) through which fuel is returned toward junction tube portion 42. Reflux control valve 43 is operably accommodated in valve casing 38 in a fluid-tight fashion by means of cover 39 and a plurality of O rings each of which is fitted between the inner periphery of valve casing 38 and the outer periphery of reflux control valve 43. Reflux control valve 43 is formed at its inflow portion with a cylindrical filter 43B. The fuel flowing through cylindrical filter 43B into the interior of reflux control valve 43 is injected or flown from the nozzle end of injection nozzle portion 43A into connecting tube portion 41, only when a valve portion (not shown) of injection nozzle portion 43A is opened. Reflux control valve 43 has a connector 43C that is connected to an input/output interface (I/O) of an electronic engine control unit (ECU) for receiving an electromagnetic-actuator control signal from the ECU. When the electromagnetic actuator of reflux control valve 43 is energized in response to a control signal (an ON signal) from the ECU, the valve portion of injection nozzle portion 43A of reflux control valve 43 opens. Conversely when the electromagnetic actuator of reflux control valve 43 is de-energized in response to a control signal (an OFF signal) from the ECU, the valve portion of injection nozzle portion 43A of reflux control valve 43 closes. That is, reflux control valve 43 is constructed as a normally-closed electromagnetic valve that is held at its closed position by means of spring bias of a valve spring when de-energized. More concretely, by way of duty-cycle control, the control signal to the electromagnetic solenoid of reflux control valve 43 is regulated or pulsed on and off, thereby energizing and de-energizing the solenoid contained within the injector body. As a matter of course, the longer the solenoid is energized, the greater the flow of fuel (fuel quantity) from reflux control valve 43 into connecting tube portion 41. In this manner, the quantity of fuel injected from injection nozzle portion 43A of reflux control valve 43 can be variably controlled responsively to the control signal from the ECU. As set forth above, reflux control valve 43 has almost the same electromagnetic-valve structure as the fuel injector 10, and additionally the injection nozzle portion 43A of reflux control valve 43 is designed so that its fluid-flow passage area is relatively smaller than that of pressure regulator 25. Thus, when reflux control valve 43 is conditioned in its valve-open position, the fluid passage defined in injection nozzle portion 43A functions as a fluid-flow restriction orifice passageway (or a fixed-orifice fluid-flow control passageway). In other words, in the system of the first embodiment, a reflux control device, which controls or adjusts the flow rate of fuel flowing through the reflux pipe arrangement into the fuel tank, is constructed by reflux control valve 43 with injection nozzle portion 43A.

Jet pump 44 is provided in main-tank portion 22 of fuel tank 21. Jet pump 44 serves as a fuel induction device that inducts fuel from sub-tank portion 23 to main-tank portion 22. The inflow side of jet pump 44 is connected via second connecting pipe (downstream connecting pipe) 36 to junction tube portion 42. The fuel induction side of jet pump 44 is connected via a hose 45 to sub-tank portion 23. Jet pump 44 operates to suck or induct the fuel stored in sub-tank portion 23 from sub-tank portion 23 through hose 45 into main-tank portion 22, utilizing return fuel flow of fuel returned from downstream connecting pipe 36 to main-tank portion 22. In FIG. 1, a vent portion denoted by reference sign 46 is an evaporation-gas (fuel-vapor) vent that is mounted to the inner periphery of tank 21. Evaporation-gas vent 46 is connected via a vapor vent line 47 to a charcoal or a carbon canister (not shown) filled with activated charcoal or activated carbon. The activated charcoal or activated carbon in the canister serves to trap or adsorb fuel vapors created in tank 21 and coming from tank 21 in to the canister. Later, when the engine starts and the vehicle is accelerating, that is, during off-idling such as during part-throttle operation or during full-throttle operation, fresh air flows through the canister and picks up the fuel vapor temporarily trapped. Then, the air flows through a purge line (not shown) into an intake manifold (not shown) and becomes part of the air/fuel mixture entering the engine cylinders. In this manner, during off-idling the trapped fuel vapor is cleared from the canister, that is, the canister is purged of fuel vapor.

Figure 7:
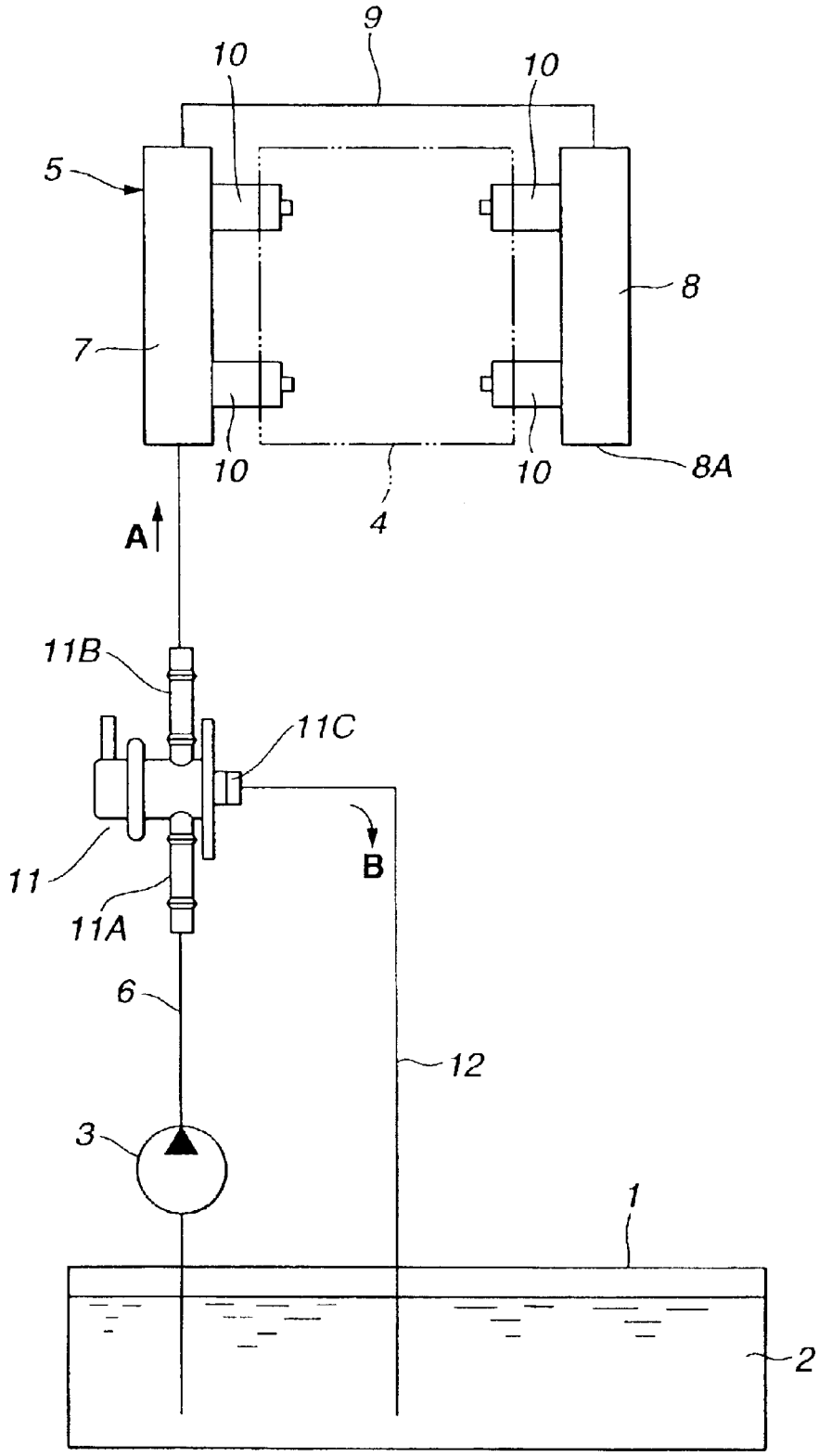
FIG. 7 is a fuel-injection system component layout showing an example of a non-return system.
Figure 8:
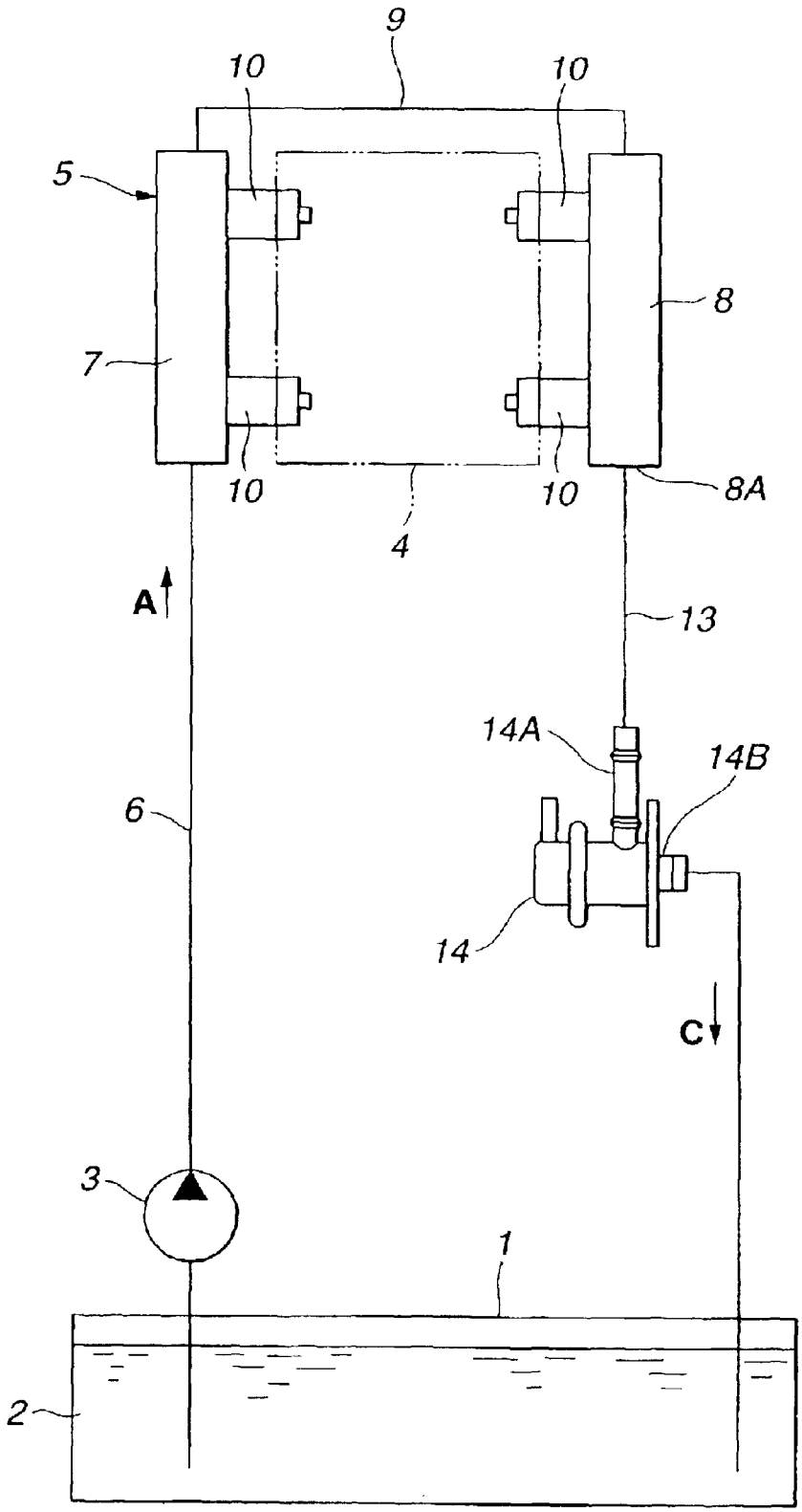
FIG. 8 is a fuel-injection system component layout showing an example of a full-return system.

With the previously-described arrangement, the fuel-injection system of the first embodiment of FIGS. 1 and 2 basically operates in a similar manner to the non-return system of FIG. 7. However, in the system of the first embodiment, of feed pipe 6, fuel distributor pipes 7 and 8, and connecting pipe 9 constructing supply line 5, first connecting pipe 35 of reflux pipe arrangement 34 is connected to the second-distributor-pipe downstream end 8A, while second connecting pipe 36 of reflux pipe arrangement 34 is connected to fuel tank 21. Additionally, Reflux control valve 43 is disposed in the middle of reflux pipe arrangement 34 such that reflux control valve 43 is operably built within valve casing 38 of valve assembly 37. Therefore, opening reflux control valve 43 in response to the control signal from the ECU, permits fuel to flow from second distributor pipe 8 toward first connecting pipe 35 (see the fuel flow indicated by the arrow D in FIGS. 1 and 2) and then to flow the fuel through inflow conduit portion 40 of valve assembly 37 and reflux control valve 43 into connecting tube portion 41 (see the fuel flow indicated by the arrow E in FIG. 2). By means of connecting tube portion 41 interconnecting the pressure regulator portion and the valve assembly 37, the surplus fuel flowing from return conduit portion 31 of pressure regulator 25 into connecting tube portion 41 (see the fuel flow indicated by the arrow B in FIG. 2) and the fuel flowing through reflux control valve 43 into connecting tube portion 31 are joined together within connecting tube portion 41. The joined fuel flow can be consecutively returned through junction tube portion 42 and second connecting pipe (downstream connecting pipe) 36 to tank 21. As a result of this, even when fuel vapors are created within distributor pipes 7 and 8, it is possible to remove or clear the fuel vapors from the distributor pipes by way of the fuel flow through reflux pipe arrangement 34, and to direct the same toward fuel tank 21. Thus, according to the system of the first embodiment, it is possible to effectively suppress or prevent the fuel vapors from being blended with fuel injected from each fuel injector 10. In addition to the above, when the electromagnetic actuator of reflux control valve 43 is de-energized in response to the control signal (OFF signal) from the ECU and thus reflux control valve 43 closes, it is possible to block the fuel flow from first connecting pipe 35 of reflux pipe arrangement 34 to reflux control valve 43 in the direction indicated by the arrow D in FIGS. 1 and 2. With the reflux control valve closed, the system of the first embodiment operates in the same manner as the non-return system of FIG. 7. That is, as a result of fuel-pressure regulating action of pressure regulator 25, as the surplus fuel, most of the fuel discharged from pump 24 returns through return conduit portion 31 of pressure regulator 25 via connecting tube portion 41, junction tube portion 42, and second connecting pipe (downstream connecting pipe) 36 to tank 21 (see the return fuel flow indicated by the arrows B and F in FIG. 2), without flowing through distributor pipes 7 and 8. With the reflux control valve closed, the system of the first embodiment permits the surplus fuel to take a short path extending from pressure-regulator return conduit portion 31 via connecting tube portion 41, junction tube portion 42, and second connecting pipe 36 to tank 21. Thus, it is possible to efficiently returning or directing the surplus fuel (most of the fuel discharged from pump 24) to tank 21 as a result of fuel-pressure regulating action of pressure regulator 25 in the same manner as the non-return system of FIG. 7, while preventing fuel flow in the direction indicated by the arrow A in FIG. 1. Therefore, it is possible to suppress or prevent the temperature in the surplus fuel from being largely affected by heat from the engine, thereby avoiding the temperature in fuel stored in tank 21 from being undesirably increased owing to heat transferred from engine 4 to the surplus fuel returning to tank 21. The system of the first embodiment operates to keep reflux control valve 43 in its closed state under a particular condition that a residual quantity of fuel in tank 21 is little and thus evaporation gas (fuel vapor) tends to create with in tank 21. With reflux control valve 43 kept in the closed state, it is possible to effectively suppress or prevent a temperature in fuel 2 in tank 21 from rising undesirably. That is, controlling the reflux control valve to the closed state reduces or suppresses evaporation gas from generating within tank 21. As discussed above, the system of the first embodiment can realize stable fuel-injection amount control even under the previously-described particular condition of a slight residual quantity of fuel in tank 21. In addition to the above, the system of the first embodiment operates to keep reflux control valve 43 in its full-open state when restarting the engine. Thus, even when fuel vapors emanate from fuel 2 within distributor pipes 7 and 8 in particular during engine hot restarting, with reflux control valve 43 kept in the full-open state the fuel vapors can be carried into tank 21 together with return fuel flow of fuel flowing through reflux pipe arrangement 34 into tank 21. The system of the first embodiment can effectively remove or clear the fuel vapors from the distributor pipes, and thus suppress or prevent the fuel vapors from being blended with fuel injected from each fuel injector 10. As set out above, by way of synergistic effect of reduced fuel vapors and removal of fuel vapors from distributor pipes 7 and 8 through reflux control valve 43 into tank 21, the system of the first embodiment can enhance the restartability of the engine.

Furthermore, reflux control valve 43 incorporated in the system of the shown embodiment has almost the same electromagnetic-valve structure as the fuel injector. That is, for optimal reflux fuel flow control one of a plurality of different sorts of fuel injectors may be easily selected and used as a reflux control valve, which has a proper specification suited to a discharge amount of fuel pump 24, an injection amount of fuel injector 10, and the like. By virtue of the reflux control valve properly selected from the different sorts of fuel injectors, the system of the shown embodiment can adjust or regulate a fluid-flow rate of fuel flowing through reflux pipe arrangement 34 to an optimal flow rate. As described previously, reflux control valve 43 incorporated in the system of the shown embodiment has almost the same electromagnetic-valve structure as the fuel injector. In other words, reflux control valve 43 has almost the same operating time (required for shifting from one of the full-open state and the fully-closed state to the other) as each fuel injector 10. Thus, it is possible to finely precisely execute the reflux fuel flow control by timely opening or closing reflux control valve 43 disposed in reflux pipe arrangement 34. Such high-precision reflux fuel flow control contributes to more stable fuel-injection control, thereby enhancing the reliability or stability of air/fuel mixture ratio (A/F) control. Moreover, the fluid-flow passage area of injection nozzle portion 43A of reflux control valve 43 is designed to be relatively smaller than that of pressure regulator 25. That is, the fluid-flow rate of fluid flowing through reflux control valve 43 can be controlled or adjusted to a flow rate relatively smaller than that of surplus fuel returned from pressure regulator 25 to tank 21. Therefore, the system of the shown embodiment can provide stable fuel-pressure-regulating action of pressure regulator 25, thus preventing or suppressing the fuel pressure in each of distributor pipes 7 and 8 from undesirably fluctuating due to opening or closing operations of reflux control valve 43. Additionally, in the shown embodiment, reflux control valve 43 is laid out in such a manner as to be accommodated in valve casing 38 of valve assembly 37 that is integrally connected to pressure regulator 25. Reflux control valve 43 can be handled as a component part constructed integral with pressure regulator 25, and therefore reflux control valve 43 can be detachably installed on the floor panel corresponding to the bottom portion of the engine together with pressure regulator 25. Second connecting pipe (downstream connecting pipe) 36 of reflux pipe arrangement 34 also serves as a common fuel return passage for pressure regulator 25 as well as reflux pipe arrangement 34. This reduces the number of component parts of the fuel-injection system. Even if reflux control valve 43 fails for example owing to breaking of a harness wire, the reflux control valve can be held at its closed position. That is, in presence of a failure in reflux control valve 43, fluid communication between reflux pipe arrangement 34 and tank 21 is blocked and thus the system of the first embodiment of FIGS. 1 and 2 operates in a similar manner to the non-return system of FIG. 7. In this case, only the pressure regulator operates satisfactorily and thus, as the surplus fuel, most of the fuel discharged from pump 24 returns through the pressure-regulator return conduit portion 31 via connecting tube portion 41, junction tube portion 42, and second connecting pipe 36 (the common fuel return passage common to both pressure regulator 25 and reflux pipe arrangement 34) to tank 21 (see the surplus fuel flow indicated by the arrows B and F in FIG. 2). That is, the system of the first embodiment can provide a fail-safe function even in the presence of a failure in reflux control valve 43.

Figure 3:
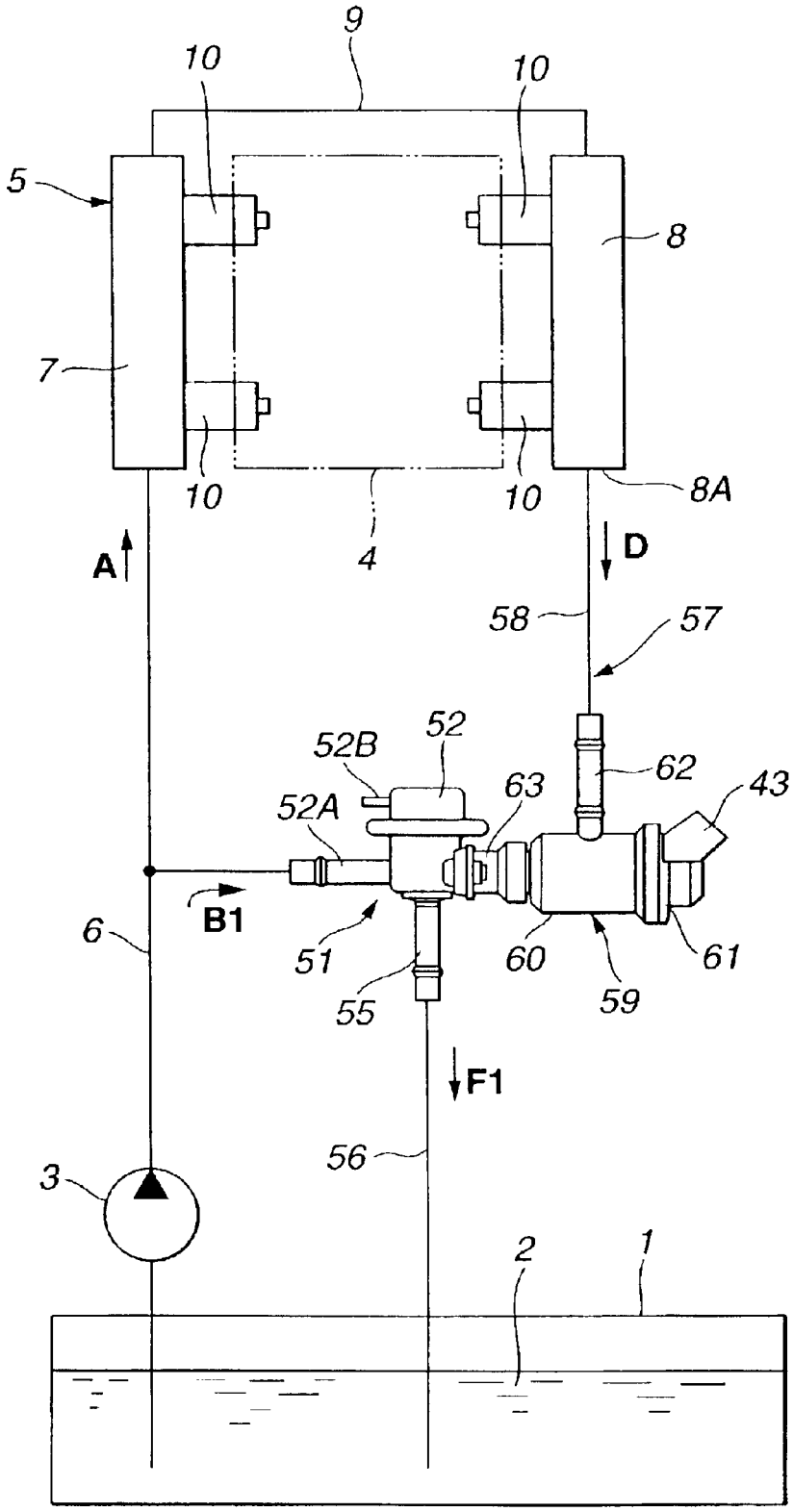
FIG. 3 is a fuel-injection system component layout of a second embodiment.
Figure 4:
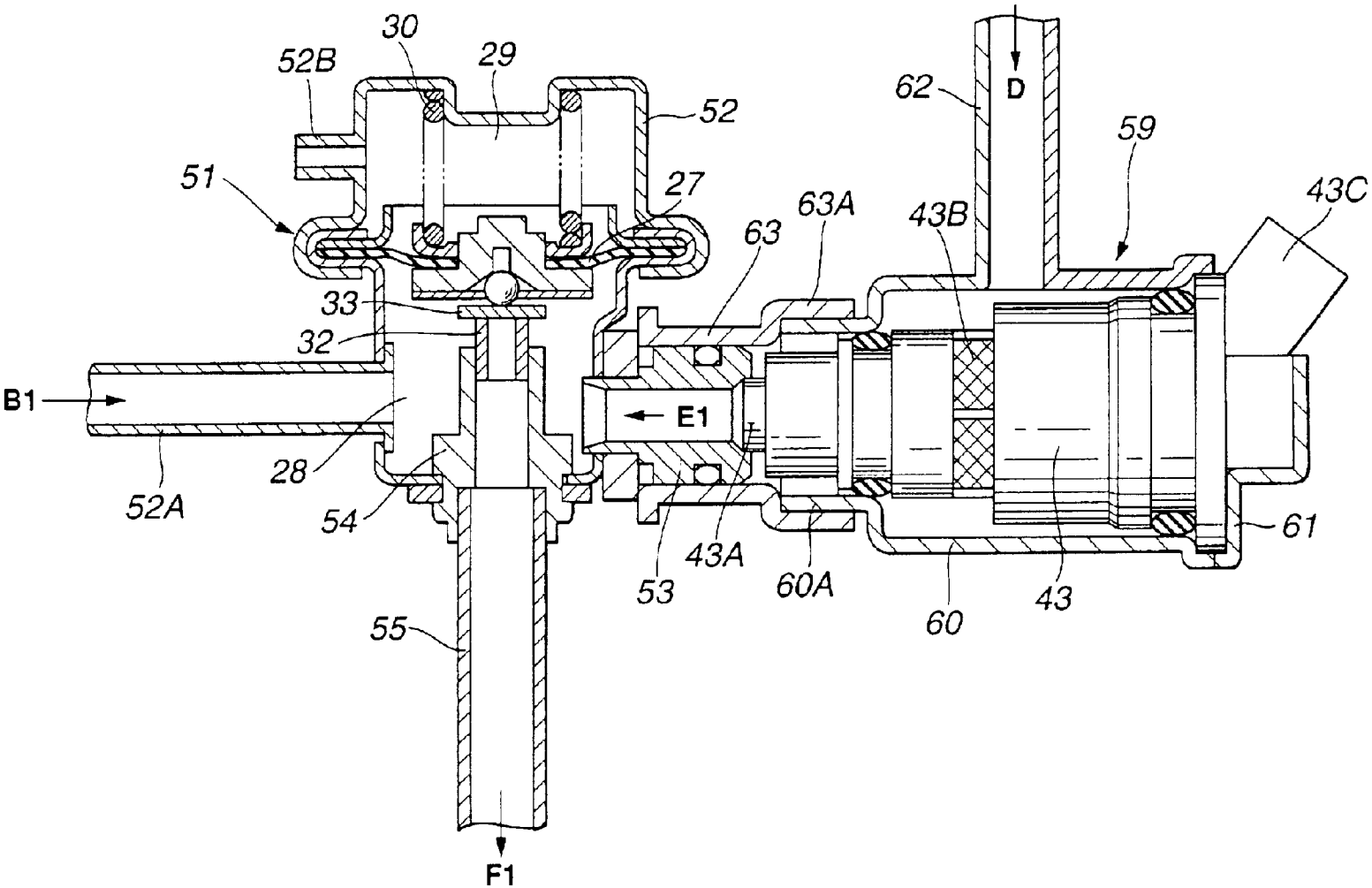
FIG. 4 is an enlarged longitudinal cross-sectional view illustrating a pressure regulator and a valve assembly incorporated in the system of the second embodiment shown in FIG. 3.

Referring now to FIGS. 3 and 4, there is shown the fuel-injection system of the second embodiment. The system of the second embodiment is different from that of the first embodiment in that a pressure regulator 51 of the system of the second embodiment has first and second inflow conduit portions 52A and 53 and the downstream end of a reflux pipe arrangement 57 (described later), that is, a connecting tube portion 63 (described later) of a valve assembly 59 (described later) is directly connected to the inflow side (second inflow conduit portion 53) of pressure regulator 51. In a similar manner to the integrated valve unit (pressure regulator 25 and valve assembly 37 integrally connected to each other) of the system of the first embodiment, in the system of the second embodiment pressure regulator 51 and reflux control valve 43 are united together or integrated with each other by integrally connecting pressure regulator 51 to valve assembly 59 that accommodates therein reflux control valve 43. Pressure regulator 51 is comprised of a regulator casing 52, a fuel return conduit portion 54, diaphragm 27, diaphragm spring 30, cylindrical-hollow valve seat 32, and valve portion 33. As fully described later, the shapes of regulator casing 52 and fuel return conduit portion 54, each constructing a part of pressure regulator 51 of the system of the second embodiment, are different from those of regulator casing 26 and fuel return conduit portion 31, constructing a part of pressure regulator 25 of the system of the first embodiment. The interior space of regulator casing 52 is divided into fuel chamber 28 and control pressure chamber 29 by diaphragm 27. Casing 52 is formed integral with a first inflow conduit portion 52A that communicates fuel chamber 28. As clearly shown in FIG. 3, first inflow conduit portion 52A is fluidly connected to a middle of feed pipe 6. A part of casing 52 defining control pressure chamber 29 is formed integral with a control pressure induction tube portion 52B that is connected via an air induction conduit (not shown) to an intake manifold of engine 4 so as to introduce manifold vacuum into control pressure chamber 29. As appreciated from the cross section shown in FIG. 4, casing 52 is also formed integral with second inflow conduit portion 53. Second inflow conduit portion 53 is arranged to oppose to first inflow conduit portion 52A in a radial direction of casing 52. Second inflow conduit portion 53 is connected to a connecting tube portion 63 of valve assembly 59. Fuel return conduit portion 54 is located in fuel chamber 28 and serves as a fuel return passage that is mounted to the bottom of the pressure-regulator casing 52. One axial end of fuel return conduit portion 54 protrudes into fuel chamber 28 toward valve portion 33 in the axial direction of the pressure-regulator casing. Cylindrical-hollow valve seat 32 is attached or fitted into the cylindrical one axial end of fuel return conduit portion 54. The other end of fuel return conduit portion 54 projects outwards from the bottom of the pressure-regulator casing. The outwardly projected end of fuel return conduit portion 54 is connected to a fuel return tube portion 55. In order to form the surplus fuel return line from fuel chamber 28 into tank 1, fuel return tube portion 55 is connected via a connection pipe 56 to tank 1 (see FIG. 3). As clearly shown in FIG. 3, a return line denoted by reference sign 57 is the reflux pipe arrangement. Reflux pipe arrangement 57 includes connecting pipes 58, 56, and valve assembly 59. One end of connecting pipe 58 is connected to the downstream end 8A of supply line 5 (or second distributor pipe 8), whereas the other end of connecting pipe 58 is connected to an inflow conduit portion 62 of valve assembly 59. As can be seen from FIG. 3, valve assembly 59 functions as a pipe-connecting member and also constructs a part of reflux pipe arrangement 57. Valve assembly 59 includes a cylindrical valve casing 60, a cover 61, inflow conduit portion 62, and connecting tube portion 63. Reflux control valve 43 is operatively accommodated in valve casing 60. Cover 61 hermetically seals one end of valve casing 60 under a condition that reflux control valve 43 is installed in valve casing 60. Inflow conduit portion 62 extends in the radial direction of cylindrical valve casing 60 and communicates with the inflow side of reflux control valve 43. The other end of valve casing 60, which faces apart from cover 61 in the axial direction, is formed as a diametrically-diminished cylindrical portion 60A. A diametrically-enlarged cylindrical portion 63A of connecting tube portion 63 is fitted onto the outer periphery of diametrically-diminished cylindrical portion 60A in a fluid-tight fashion. Actually, diametrically-enlarged cylindrical portion 63A of connecting tube portion 63 is fixedly connected to the outer periphery of diametrically-diminished cylindrical portion 60A by way of welding or blazing. Injection nozzle portion 43A of reflux control valve 43 is fitted into diametrically-diminished cylindrical portion 60A of valve casing 60. A seal ring such as an O ring is disposed between the outer periphery of injection nozzle portion 43A and the inner periphery of diametrically-diminished cylindrical portion 60A so as to provide tight seal. Connecting tube portion 63 constructs a part of valve assembly 59. Connecting tube portion 63 is made of acetal pipe material having a substantially cylindrical shape. One end (i.e., diametrically-enlarged cylindrical portion 63A) of connecting tube portion 63 is fixedly connected and fitted to diametrically-diminished cylindrical portion 60A of valve casing 60. The other end of connecting tube portion 63 is fitted onto second inflow conduit portion 53 of pressure regulator 51 by means of fastening means for example bolts and nuts. As can be appreciated from the above, injection nozzle portion 43A of reflux control valve 43 is communicated with second inflow conduit portion 53 of pressure regulator 51 by connecting diametrically-enlarged cylindrical portion 63A of connecting tube portion 63 to diametrically-diminished cylindrical portion 60A of valve casing 60 and by connecting or fitting the other end of connecting tube portion 63 to second inflow conduit portion 53 of pressure regulator 51.

As discussed above, in the system of the second embodiment of FIGS. 3 and 4, pressure regulator 51 has first and second inflow conduit portions 52A and 53 and additionally connecting tube portion 63 of valve assembly 59 is connected to the inflow side (exactly, second inflow conduit portion 53) of pressure regulator 51. Therefore, with reflux control valve 43 held at its valve-open position, the fuel in second distributor pipe 8 flows through connecting pipe 58 in the fluid-flow direction indicated by the arrow D in FIGS. 3 and 4. The fuel flowing through connecting pipe 58 then flows via inflow conduit portion 62 of valve assembly 59 and injection nozzle portion 43A of reflux control valve 43 into connecting tube portion 63, exactly, second inflow conduit portion 53 of pressure regulator 51 (see the fluid-flow direction indicated by the arrow E1). By way of the use of first and second inflow conduit portions 52A and 53 connected to fuel chamber 28 of pressure regulator 51, the surplus fuel flowing from first inflow conduit portion 52A into fuel chamber 28 (see the fuel flow indicated by the arrow B1 in FIG. 4) and the fuel flowing through reflux control valve 43 and second inflow conduit portion 53 into fuel chamber 28 (see the fuel flow indicated by the arrow E1 in FIG. 4) are joined together within fuel chamber 28 of pressure regulator 51. The joined fuel flow can be returned through fuel return tube portion 55 of pressure regulator 51 and connecting pipe 56 to tank 1, with valve portion 33 of pressure regulator 51 conditioned in its valve-open state (see the fuel flow indicated by the arrow F1 in FIGS. 3 and 4). As a result of this, even when fuel vapors are created within distributor pipes 7 and 8, it is possible to remove or clear the fuel vapors from the distributor pipes by way of the fuel flow through reflux pipe arrangement 57 and fuel return tube portion 55 of pressure regulator 51, and to direct the same toward fuel tank 1. Thus, according to the system of the second embodiment, it is possible to effectively suppress or prevent the fuel vapors from being blended with fuel injected from each fuel injector 10. In addition to the above, when the electromagnetic actuator of reflux control valve 43 is de-energized in response to the control signal (OFF signal) from the ECU and thus reflux control valve 43 closes, it is possible to block the fuel flow from connecting pipe 58 of reflux pipe arrangement 57 to reflux control valve 43 in the direction indicated by the arrow D in FIGS. 3 and 4. With the reflux control valve closed, the system of the second embodiment operates in the same manner as the non-return system of FIG. 7. That is, as a result of fuel-pressure regulating action of pressure regulator 51, as the surplus fuel, most of the fuel discharged from pump 3 returns through first inflow conduit portion 52A of pressure regulator 51 via fuel chamber 28, fuel return conduit portion 54, fuel return tube portion 55, and connecting pipe 56 to tank 1 (see the return fuel flow indicated by the arrows B1 and F1 in FIG. 4), without flowing through distributor pipes 7 and 8. That is, with the reflux control valve closed, the system of the second embodiment permits the surplus fuel to take a short path extending from first inflow conduit portion 52A of pressure regulator 51 via fuel chamber 28, pressure-regulator return conduit portion 54, fuel return tube portion 55, and connecting pipe 56 to tank 1. Thus, it is possible to efficiently returning or directing the surplus fuel (most of the fuel discharged from pump 3) to tank 1 as a result of fuel-pressure regulating action of pressure regulator 51 in the same manner as the non-return system of FIG. 7, while preventing fuel flow in the direction indicated by the arrow A in FIG. 3. Therefore, it is possible to suppress or prevent the temperature in the surplus fuel from being largely affected by heat from the engine, thereby avoiding the temperature in fuel stored in tank 1 from being undesirably increased owing to heat transferred from engine 4 to the surplus fuel returning to tank 1. The system of the second embodiment operates to keep reflux control valve 43 in its closed state under a particular condition that a residual quantity of fuel in tank 1 is little and thus evaporation gas (fuel vapor) tends to create within tank 1. With reflux control valve 43 kept in the closed state, it is possible to effectively suppress or prevent a temperature in fuel 2 in tank 1 from rising undesirably. That is, controlling the reflux control valve to the closed state reduces or suppresses evaporation gas from generating within tank 1. In addition to the above, the system of the second embodiment operates to keep reflux control valve 43 in its full-open state when restarting the engine. Thus, even when fuel vapors emanate from fuel 2 within distributor pipes 7 and 8 in particular during engine hot restarting, with reflux control valve 43 kept in the full-open state the fuel vapors can be carried into tank 1 by virtue of return fuel flow of fuel flowing through reflux pipe arrangement 57 in to tank 1. The system of the second embodiment can effectively remove or clear the fuel vapors from the distributor pipes, and thus suppress or prevent the fuel vapors from being blended with fuel injected from each fuel injector 10. As set out above, by way of synergistic effect of reduced fuel vapors and removal of fuel vapors from distributor pipes 7 and 8 through reflux control valve 43 into tank 1, the system of the second embodiment can enhance the restartability of the engine.

Figure 5:
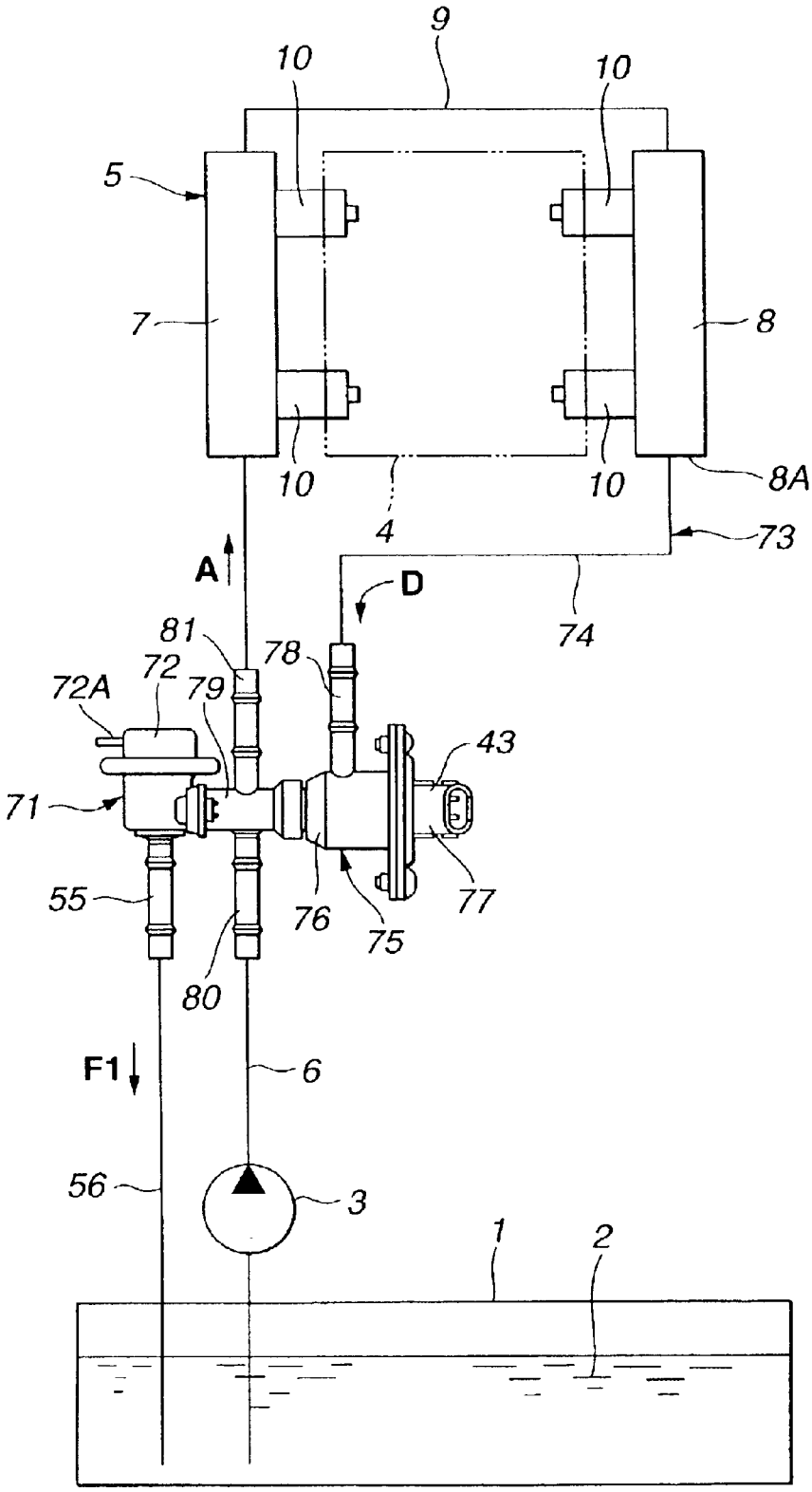
FIG. 5 is a fuel-injection system component layout of a third embodiment.

Referring now to FIG. 5, there is shown the fuel-injection system of the third embodiment. In the system of the third embodiment of FIG. 5, the downstream end of a reflux pipe arrangement 73 (described later) is directly connected to the inflow side of a pressure regulator 71 and the conduit structure of pressure regulator 71 is different from the first and second embodiments. In a similar manner to the integrated valve unit (pressure regulator 51 and valve assembly 59 integrally connected to each other) of the system of the second embodiment, in the system of the third embodiment pressure regulator 71 and reflux control valve 43 are united together or integrated with each other by integrally connecting pressure regulator 71 to a valve assembly 75 (described later) that accommodates therein reflux control valve 43. Pressure regulator 71 is comprised of a regulator casing 72, a fuel return conduit portion 55, diaphragm 27, diaphragm spring 30, cylindrical-hollow valve seat 32, and valve portion 33. The interior space of regulator casing 72 is divided into the fuel chamber and the control pressure chamber by the diaphragm. A part of casing 72 defining the control pressure chamber is formed integral with a control pressure induction tube portion 72A that is connected via an air induction conduit (not shown) to an intake manifold of engine 4 so as to introduce manifold vacuum into the control pressure chamber. Fuel return conduit portion 54 is located in the fuel chamber and serves as a fuel return passage that is mounted to the bottom of the pressure-regulator casing 72. The outwardly projected end of fuel return conduit portion 54 is connected to a fuel return tube portion 55. Note that in the system of the third embodiment a connecting tube portion 79 of valve assembly 75 that interconnects pressure regulator 71 and valve assembly 75 also serves as an inflow tube portion of pressure regulator 71. Reflux pipe arrangement 73 of the third embodiment of FIG. 5 is similar to reflux pipe arrangement 34 of the first embodiment of FIGS. 1 and 2. Reflux pipe arrangement 73 includes a connecting pipe 74 and valve assembly 75. One end of connecting pipe 74 is connected to the second-distributor-pipe downstream end 8A, whereas the other end of connecting pipe 74 is connected to an inflow conduit portion 78 of valve assembly 75. Valve assembly 75, which functions as a pipe-connecting member and also constructs a part of reflux pipe arrangement 73, is similar to valve assembly 59 of the second embodiment of FIGS. 3 and 4, in construction. That is, valve assembly 75 includes a cylindrical valve casing 76, a cover 77, inflow conduit portion 78, and connecting tube portion 79. Reflux control valve 43 is operatively accommodated in valve casing 76. Cover 77 hermetically seals one end of valve casing 76 under a condition that reflux control valve 43 is installed in valve casing 76. Inflow conduit portion 78 extends in the radial direction of cylindrical valve casing 76 and communicates with the inflow side of reflux control valve 43. Connecting tube portion 79 of the third embodiment shown in FIG. 5 has almost the same structure as connecting tube portion 63 of the second embodiment. That is, one end of connecting tube portion 79 is connected to casing 76, while the other end of connecting tube portion 79 is connected to the inflow side of pressure regulator 71. However, in the system of the third embodiment, connecting tube portion 79 is formed integral with both an inflow conduit portion 80 and an outflow conduit portion 81. Inflow conduit portion 80 and outflow conduit portion 81 are diametrically opposed to each other with respect to the central axis of the substantially cylindrical connecting tube portion 79. Inflow conduit portion 80 functions just like the inflow conduit 26A of the system of the first embodiment, while outflow conduit portion 81 functions just like the outflow conduit 26B of the system of the first embodiment. When pump 3 is activated and thus fuel 2 stored in tank 1 is discharged into feed pipe 6 of supply line 5, a portion of fuel discharged from pump 3 flows from inflow conduit portion 80 to outflow conduit portion 81 (see the fuel flow indicated by the arrow A in FIG. 5) and is delivered into distributor pipes 7 and 8 located downstream of outflow conduit portion 81. As a result of fuel-pressure regulating action of pressure regulator 71, as the surplus fuel, most of the fuel discharged from pump 3 returns through connecting tube portion 79, return conduit portion 55, and connecting pipe 56 to tank 1, without flowing through distributor pipes 7 and 8.

As discussed above, in the system of the third embodiment of FIG. 5, connecting tube portion 79 of valve assembly 75 is directly connected to the inflow side (inflow port) of pressure regulator 71. Therefore, with reflux control valve 43 held at its valve-open position, the fuel in second distributor pipe 8 flows through connecting pipe 74 in the fluid-flow direction indicated by the arrow D in FIG. 5. The fuel flowing through connecting pipe 74 then flows via inflow conduit portion 78 of valve assembly 75 and reflux control valve 43 into connecting tube portion 79, that is, the inflow side of pressure regulator 71. By means of connecting tube portion 79, the surplus fuel flowing from inflow conduit portion 80 via connecting tube portion 79 into the fuel chamber and the fuel flowing through connecting pipe 74, inflow conduit portion 78 and reflux control valve 43 into the fuel chamber (see the fuel flow indicated by the arrow D in FIG. 5) are joined together within the fuel chamber of pressure regulator 71. The joined fuel flow can be returned through fuel return tube portion 55 of pressure regulator 71 and connecting pipe 56 to tank 1, with the valve portion of pressure regulator 71 conditioned in its valve-open state (see the fuel flow indicated by the arrow F1 in FIG. 5). As a result of this, even when fuel vapors are created within distributor pipes 7 and 8, it is possible to remove or clear the fuel vapors from the distributor pipes by way of the fuel flow through reflux pipe arrangement 73 and fuel return tube portion 55 of pressure regulator 71, and to direct the same toward fuel tank 1. Thus, according to the system of the third embodiment, it is possible to effectively suppress or prevent the fuel vapors from being blended with fuel injected from each fuel injector 10. In addition to the above, when the electromagnetic actuator of reflux control valve 43 is de-energized in response to the control signal (OFF signal) from the ECU and thus reflux control valve 43 closes, it is possible to block the fuel flow from connecting pipe 74 of reflux pipe arrangement 73 to reflux control valve 43 in the direction indicated by the arrow D in FIG. 5. With the reflux control valve closed, the system of the third embodiment operates in the same manner as the non-return system of FIG. 7. That is, as a result of fuel-pressure regulating action of pressure regulator 71, as the surplus fuel, most of the fuel discharged from pump 3 returns through inflow conduit portion 80 of pressure regulator 71 via connecting tube portion 79, the fuel chamber, the fuel return conduit portion, fuel return tube portion 55, and connecting pipe 56 to tank 1, without flowing through distributor pipes 7 and 8. That is, with the reflux control valve closed, the system of the third embodiment permits the surplus fuel to take a short path extending from inflow conduit portion 80 of pressure regulator 71 via connecting tube portion 79, the fuel chamber, the fuel return conduit portion, fuel return tube portion 55, and connecting pipe 56 to tank 1. Thus, it is possible to efficiently returning or directing the surplus fuel (most of the fuel discharged from pump 3) to tank 1 as a result of fuel-pressure regulating action of pressure regulator 71 in the same manner as the non-return system of FIG. 7, while preventing fuel flow in the direction indicated by the arrow A in FIG. 5. Therefore, it is possible to suppress or prevent the temperature in the surplus fuel from being largely affected by heat from the engine, thereby avoiding the temperature in fuel stored in tank 1 from being undesirably increased owing to heat transferred from engine 4 to the surplus fuel returning to tank 1. The system of the third embodiment operates to keep reflux control valve 43 in its closed state under a particular condition that a residual quantity of fuel in tank 1 is little and thus evaporation gas (fuel vapor) tends to create within tank 1. With reflux control valve 43 kept in the closed state, it is possible to effectively suppress or prevent a temperature in fuel 2 in tank 1 from rising undesirably. That is, controlling the reflux control valve to the closed state reduces or suppresses evaporation gas from generating within tank 1. In addition to the above, the system of the third embodiment operates to keep reflux control valve 43 in its full-open state when restarting the engine. Thus, even when fuel vapors emanate from fuel 2 within distributor pipes 7 and 8 in particular during engine hot restarting, with reflux control valve 43 kept in the full-open state the fuel vapors can be carried into tank 1 by virtue of return fuel flow of fuel flowing through reflux pipe arrangement 73 into tank 1. The system of the third embodiment can effectively remove or clear the fuel vapors from the distributor pipes, and thus suppress or prevent the fuel vapors from being blended with fuel injected from each fuel injector 10. As set out above, by way of synergistic effect of reduced fuel vapors and removal of fuel vapors from distributor pipes 7 and 8 through reflux control valve 43 into tank 1, the system of the third embodiment can enhance the restartability of the engine.

Figure 6:
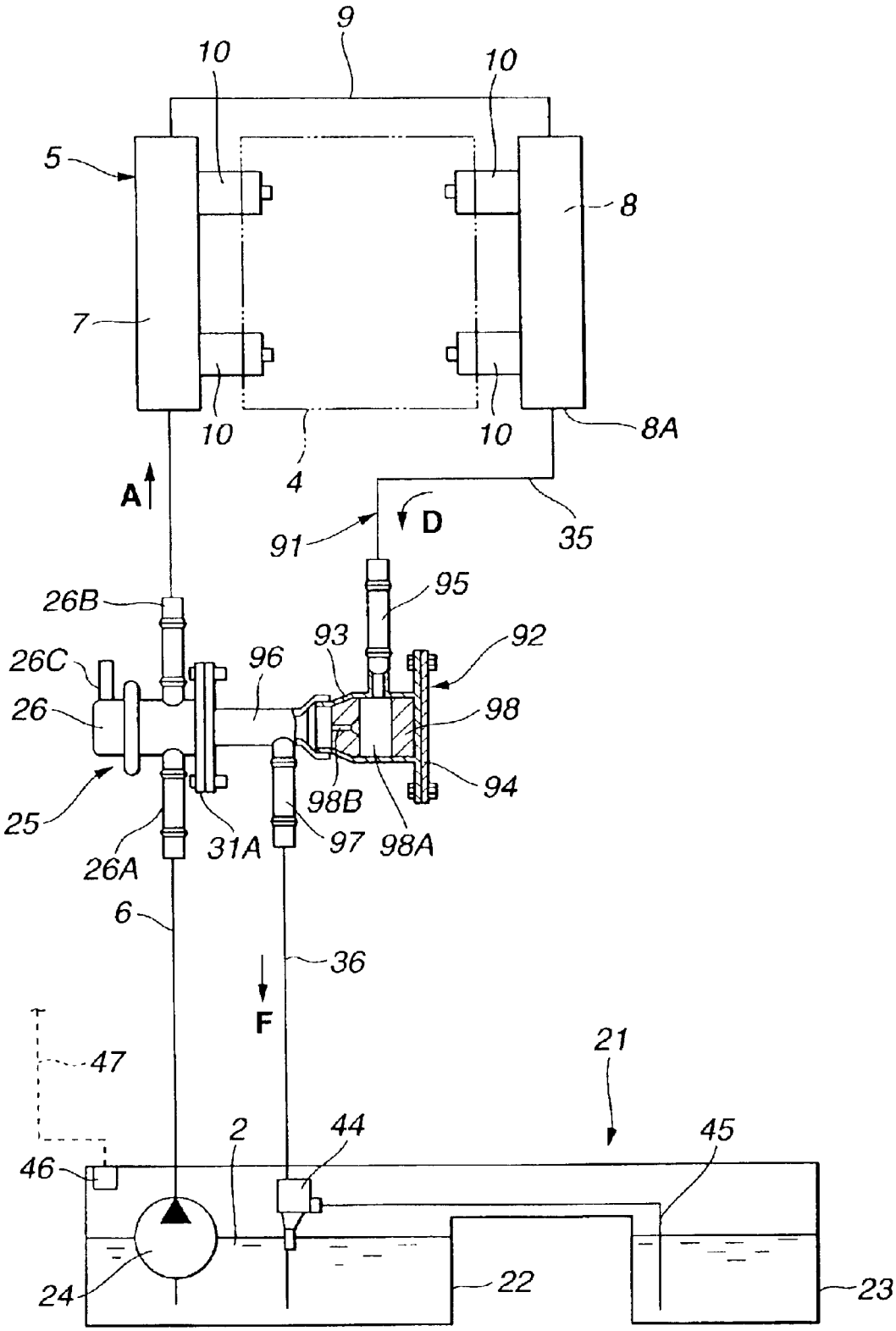
FIG. 6 is a fuel-injection system component layout of a fourth embodiment.

Referring now to FIG. 6, there is shown the fuel-injection system of the fourth embodiment. The system of the fourth embodiment shown in FIG. 6 is different from the system of the first embodiment shown in FIGS. 1 and 2, in that an orifice assembly 92 is used instead of using valve assembly 37 having reflux control valve 43. That is, orifice assembly 92, which has a fluid-flow restriction orifice member 98 and integrally connected to pressure regulator 25, is disposed in a middle of a reflux pipe arrangement 91 (described later). Orifice member 98 serves to restrict and adjust a flow rate of fuel flowing through reflux pipe arrangement 91 to a designated small flow rate. Reflux pipe arrangement 91 incorporated in the system of the fourth embodiment of FIG. 6 is similar to reflux pipe arrangement 34 incorporated in the system of the first embodiment of FIGS. 1 and 2. Orifice assembly 92 is disposed in the middle of reflux pipe arrangement 91 and located between first and second connecting pipes 35 and 36. That is, orifice assembly 92, which functions a pipe-connecting member, also constructs a part of reflux pipe arrangement 91. The structure of orifice assembly 92 is somewhat similar to that of valve assembly 37 of the first embodiment. However, orifice assembly 92 of the fourth embodiment is different from valve assembly 37 of the first embodiment, in that orifice assembly 92 has a cylindrical orifice casing 93 that accommodates therein the orifice member 98. As can be seen from the partial cross section of FIG. 6, orifice assembly 92 includes cylindrical orifice casing 93, a cover 94, an inflow conduit portion 95, a connecting tube portion 96, and a junction tube portion 97. Cover 94 hermetically seals one end of orifice casing 93 under a condition that orifice member 98 is installed in orifice casing 93. Inflow conduit portion 95 extends in the radial direction of cylindrical orifice casing 93 and communicates with the inflow side of orifice member 98. The other end of orifice casing 93, which faces apart from cover 94 in the axial direction, is formed as a diametrically-diminished cylindrical portion. A diametrically-enlarged cylindrical portion of connecting tube portion 96 is fitted onto the outer periphery of the diametrically-diminished cylindrical portion of orifice casing 93 in a fluid-tight fashion. Actually, the diametrically-enlarged cylindrical portion of connecting tube portion 96 is fixedly connected to the outer periphery of the diametrically-diminished cylindrical portion by way of welding or blazing. Connecting tube portion 96 functions just like the connecting tube portion 41 of the system of the first embodiment, while junction tube portion 97 functions just like the junction tube portion 42 of the system of the first embodiment. As clearly shown in FIG. 6, orifice member 98 is formed with a radial oil hole 98A that communicates with inflow conduit portion 95 and an axial fluid-flow restriction orifice passageway (or an axial fixed-orifice fluid-flow control passageway) 98B that communicates at one axial end with radial oil hole 98A and communicates at the other axial end with connecting tube portion 96. Orifice member 98 functions to restrict the flow rate of fluid flowing from second distributor pipe 8 through first connecting pipe 35 and inflow conduit portion 95 into radial oil hole 98A (see the fuel flow indicated by the arrow D in FIG. 6) to a designated small flowrate. That is, in the system of the fourth embodiment, a reflux control device is constructed by orifice member 98 with axial fluid-flow restriction orifice passageway 98B. The orifice passage area of axial orifice passageway 98B of orifice member 98 is dimensioned to be relatively smaller than a surplus-fuel-flow passage area of the pressure regulator. By way of flow restricting action of orifice member 98, the flow rate of fuel flowing through reflux pipe arrangement 91 can be suppressed or reduced to a relatively smaller flow rate in comparison with the flow rate of surplus fuel flowing through pressure regulator 25 and connecting tube portion 96 and returning via junction tube portion 97 to tank 21. The flow restricting action of orifice member 98, contributes to stable fuel-pressure-regulating action of pressure regulator 25. As necessary, a fuel filter (not shown) is placed in radial oil hole 98A of orifice member 98 for removing dart, debris and other contaminants from the fuel and for preventing axial fluid-flow restriction orifice passageway 98B from clogging due to contaminants.

With the previously-described arrangement, the system of the fourth embodiment of FIG. 6 can provide the same effects as the system of the first embodiment of FIGS. 1 and 2. That is, in the system of the fourth embodiment of FIG. 6, orifice assembly 92, which is integrally connected to pressure regulator 25, is disposed in the middle of reflux pipe arrangement 91, and additionally orifice member 98 having axial fluid-flow restriction orifice passageway 98B is placed within cylindrical orifice casing 93. Therefore, by way of the orifice member 98, the fuel in second distributor pipe 8 flows through connecting pipe 35 in the fluid-flow direction indicated by the arrow D in FIG. 6. The fuel flowing through connecting pipe 35 then flows via inflow conduit portion 95 of orifice assembly 92, radial oil hole 98A of orifice member 98 and axial fluid-flow restriction orifice passageway 98B into connecting tube portion 96, that is, the inflow side of pressure regulator 25. At this time, the flow rate of the fuel flowing via inflow conduit portion 95, radial oil hole 98A and axial orifice passageway 98B into connecting tube portion 96 can be suppressed or reduced to a relatively smaller flow rate than the flow rate of surplus fuel flowing from pressure regulator 25 into connecting tube portion 96. By means of connecting tube portion 96 interconnecting the pressure regulator portion and the orifice assembly 92, the surplus fuel flowing from the return conduit portion of pressure regulator 25 into connecting tube portion 96 and the fuel flowing through orifice member 98 into connecting tube portion 96 are joined together within connecting tube portion 96 or within junction tube portion 97. The joined fuel flow can be consecutively returned through junction tube portion 97 and second connecting pipe 36 to tank 21 (see the fuel flow indicated by the arrow F in FIG. 6). As a result of this, even when fuel vapors are created within distributor pipes 7 and 8, it is possible to remove or clear the fuel vapors from the distributor pipes by way of the fuel flow through reflux pipe arrangement 91 and the orifice passageway of orifice member 98, and to direct the same toward fuel tank 21. Thus, according to the system of the fourth embodiment, it is possible to effectively suppress or prevent the fuel vapors from being blended with fuel injected from each fuel injector 10. As discussed above, according to the system of the fourth embodiment, by way of flow restricting action of orifice member 98, the flow rate of fuel flowing through reflux pipe arrangement 91 can be suppressed or reduced to a relatively smaller flow rate than the flow rate of surplus fuel flowing through pressure regulator 25. This ensures stable fuel-pressure-regulating action of pressure regulator 25, thus enhancing the reliability or stability of air/fuel mixture ratio (A/F) control. In addition to he the above, the flow rate of fuel flowing through distributor pipes 7 and 8 of supply line 5 (see the fuel flow indicated by the arrow A in FIG. 6) is properly restricted by means of orifice member 98, and therefore the properly restricted fuel flow (of a small fuel flow rate) can be returned via the orifice passageway of orifice member 98 into fuel tank 21. That is, a properly restricted flow rate of fuel can circulate through distributor pipes and reflux pipe arrangement 91. This effectively suppresses or prevents the temperature in fuel flowing through the fuel line from being largely affected by heat from the engine, thereby suppressing the temperature in fuel in distributor pipes 7 and 8 from being undesirably increased owing to heat transferred and thus reducing the amount of fuel vapors created. Furthermore, in the system of the fourth embodiment, orifice member 98 is formed with axial fluid-flow restriction orifice passageway 98B having a small orifice size. Fuel vapors contained in the fuel flow from inflow conduit portion 95 of orifice assembly 92 into radial oil hole 98 A can be preferentially carried via the orifice passageway 98B into connecting tube portion 96 and junction tube portion 97. Thus, the fuel vapors created can be efficiently carried or collected into tank 21. Moreover, in the system of the fourth embodiment of FIG. 6, orifice member 98 is accommodated in cylindrical orifice casing 93 of orifice assembly 92 that is integrally connected to pressure regulator 25. That is, orifice member 98 can be handled as a component part constructed integral with pressure regulator 25, and therefore orifice member 98 can be detachably installed on the floor panel corresponding to the bottom portion of the engine together with pressure regulator 25. Second connecting pipe (downstream connecting pipe) 36 of reflux pipe arrangement 91 also serves as a common fuel return passage for pressure regulator 25 as well as reflux pipe arrangement 91, thus reducing the number of component parts of the fuel-injection system.

As described previously, in the system of the first embodiment of FIGS. 1 and 2, valve assembly 37, which functions as a pipe-connecting member, is comprised of cylindrical valve casing 38, cover 39, inflow conduit portion 40, connecting tube portion 41, and junction tube portion 42, and additionally reflux control valve 43 is accommodated in cylindrical valve casing 38. In lieu thereof, inflow conduit portion 40 may be directly connected to an inflow port of reflux control valve 43, and a pipe line containing both connecting tube portion 41 and junction tube portion 42 may be directly connected to an outflow port of reflux control valve 43. In such a case, it is possible to eliminate the necessity of cylindrical valve casing 38. Likewise, in order to eliminate the necessity of cylindrical valve casing 60, in the system of the second embodiment of FIGS. 3 and 4, inflow conduit portion 62 may be directly connected to an inflow port of reflux control valve 43, and a pipe line containing at least connecting tube portion 63 may be directly connected to an outflow port of reflux control valve 43. In a similar manner, in order to eliminate the necessity of cylindrical valve casing 76, in the system of the third embodiment of FIG. 5, inflow conduit portion 78 may be directly connected to an inflow port of reflux control valve 43, and a pipe line containing at least connecting tube portion 79 may be directly connected to an outflow port of reflux control valve 43.

In the systems of the first and fourth embodiments, fuel tank 21 is comprised of main-tank portion 22 and sub-tank portion 23, and additionally fuel pump 24 is constructed as an in-oil type pump located in main-tank portion 22. In lieu thereof, each of the systems of the first and fourth embodiments may use a standard sealed fuel tank 1 as shown in FIG. 7, and also the fuel pump may be located outside of the fuel tank. In contrast to the above, each of the systems of the second and third embodiments uses a standard sealed fuel tank 1 as shown in FIG. 7, and also the fuel pump is located outside of the fuel tank. In lieu thereof, each of the systems of the second and third embodiments may use a fuel tank comprised of main-tank portion 22 and sub-tank portion 23, and additionally the fuel pump may be constructed as an in-oil type pump located in main-tank portion 22.

In the system of the second embodiment shown in FIGS. 3 and 4, reflux control valve 43 is disposed in the middle of the reflux pipe arrangement. Reflux control valve 43 incorporated in the system of the second embodiment may be replaced by orifice member 98 incorporated in the system of the fourth embodiment, because orifice member 98 can provide the same flow-restricting function as injection nozzle portion 43A of reflux control valve 43.

Although the fuel-injection systems of the first, second, third, and fourth embodiments are exemplified in a four-cylinder fuel-injected internal combustion engine, each system of the shown embodiments may be applied to the other types of engines, such as a single-cylinder engine, a two-cylinder engine, a six-cylinder engine, and the like. The systems of the shown embodiments can be used regardless of the number of fuel injectors.

The entire contents of Japanese Patent Application No. P2001-269191 (filed Sep. 5, 2001) is incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A fuel-injection system comprising:

a fuel tank storing fuel;

a fuel injector injecting the fuel;

a fuel pump inducting the fuel from the fuel tank and discharging pressurized fuel into a fuel supply line that is connected one end to the fuel pump and connected at the other end to the fuel injector;

a pressure regulator disposed in a middle of the fuel supply line and located upstream of the fuel injector for regulating a pressure of the fuel flowing through the fuel supply line and for returning surplus fuel via the pressure regulator into the fuel tank;

a reflux pipe arrangement that is located downstream of the fuel injector and connected at one end to a downstream end of the fuel supply line and connected at the other end to the fuel tank; and a reflux control device disposed in a middle of the reflux pipe arrangement for controlling a flow rate of the fuel flowing through the reflux pipe arrangement, wherein the reflux control device controls a flow rate of the fuel flowing through the reflux control device to a smaller value than a flow rate of the surplus fuel flowing through the pressure regulator to the fuel tank.

2. The fuel-injection system as claimed in claim 1, wherein:

the reflux control device comprises a fluid-flow restriction orifice member.

3. A fuel-injection system comprising:

a fuel tank storing fuel;

a fuel injector injecting the fuel;

a fuel pump inducting the fuel from the fuel tank and discharging pressurized fuel into a fuel supply line that is connected one end to the fuel pump and connected at the other end to the fuel injector;

a pressure regulator disposed in a middle of the fuel supply line and located upstream of the fuel injector for regulating a pressure of the fuel flowing through the fuel supply line and for returning surplus fuel via the pressure regulator into the fuel tank;

a reflux pipe arrangement that is located downstream of the fuel injector and connected at one end to a downstream end of the fuel supply line, the other end of the reflux pipe arrangement extending toward the fuel tank; and an orifice member constructed integral with the pressure regulator and disposed in a middle of the reflux pipe arrangement for restricting a flow rate of the fuel flowing through the reflux pipe arrangement wherein the orifice member controls a flow rate of the fuel flowing through the orifice member to a smaller value than a flow rate of the surplus fuel flowing through the pressure regulator to the fuel tank.

4. The fuel-injection system as claimed in claim 3, wherein:

the orifice member comprises a fixed orifice whose passage area is dimensioned to be relatively smaller than a surplus-fuel-flow passage area of the pressure regulator.

5. A fuel-injection system for an internal combustion engine comprising:

a sealed fuel tank storing fuel;

a fuel injector injecting the fuel;

a fuel pump inducting the fuel from the fuel tank and discharging pressurized fuel into a fuel supply line that is connected one end to the fuel pump and connected at the other end to the fuel injector, the fuel supply line comprising a distributor pipe located near combustion chambers of the engine and a feed pipe extending from the fuel pump to distributor pipe;

a pressure regulator disposed in a middle of the feed pipe and located upstream of the fuel injector for regulating a pressure of the fuel flowing through the fuel supply line and for returning surplus fuel via the pressure regulator into the fuel tank without flowing through the distributor pipe;

a reflux pipe arrangement that is located downstream of the fuel injector and connected at one end to a downstream end of the distributor pipe and connected at the other end to the fuel tank; and a reflux control device disposed in a middle of the reflux pipe arrangement for controlling a flow rate of the fuel flowing through the reflux pipe arrangement, wherein the reflux control device controls a flow rate of the fuel flowing through the reflux control device to a smaller value than a flow rate of the surplus fuel flowing through the pressure regulator to the fuel tank.

6. A fuel-injection system for an internal combustion engine comprising;

a sealed fuel tank storing fuel;

a fuel injector injecting the fuel;

a fuel pump inducting the fuel from the fuel tank and discharging pressurized fuel into a fuel supply line that is connected one end to the fuel pump and connected at the other end to the fuel injector, the fuel supply line comprising a distributor pipe located near combustion chambers of the engine and a feed pipe extending from the fuel pump to distributor pipe;

a pressure regulator disposed in a middle of the feed pipe and located upstream of the fuel injector for regulating a pressure of the fuel flowing through the fuel supply line and for returning surplus fuel via the pressure regulator into the fuel tank without flowing through the distributor pipe;

a reflux pipe arrangement that is located downstream of the fuel injector and connected at one end to a downstream end of the distributor pipe and connected at the other end to the fuel tank; and an orifice member constructed integral with the pressure regulator and disposed in a middle of the reflux pipe arrangement for restricting a flow rate of the fuel flowing through the reflux pipe arrangement wherein the orifice member controls a flow rate of the fuel flowing through the orifice member to a relatively smaller value than a flow rate of the surplus fuel flowing through the pressure regulator to the fuel tank.

7. A fuel-injection system comprising:

fuel storing means for storing fuel;

fuel injecting means for injecting the fuel;

fuel pumping means for inducting the fuel from the fuel storing means and for discharging pressurized fuel into a fuel supply line that is connected one end to the fuel pumping means and connected at the other end to the fuel injecting means;

pressure regulating means disposed in a middle of the fuel supply line and located upstream of the fuel injecting means for regulating a pressure of the fuel flowing through the fuel supply line and for returning surplus fuel via the pressure regulating means into the fuel storing means;

a reflux pipe arrangement that is located downstream of the fuel injecting means and connected at one end to a downstream end of the fuel supply line and connected at the other end to the fuel storing means; and reflux control means disposed in a middle of the reflux pipe arrangement for controlling a flow rate of the fuel flowing through the reflux pipe arrangement, wherein the reflux control means controls a flow rate of the fuel flowing through the reflux control means to a smaller value than a flow rate of the surplus fuel flowing through the pressure regulator to the fuel tank.

8. A fuel-injection system comprising:

fuel storing means for storing fuel;

fuel injecting means for injecting the fuel;

fuel pumping means for inducting the fuel from the fuel storing means and for discharging pressurized fuel into a fuel supply line that is connected one end to the fuel pumping means and connected at the other end to the fuel injecting means;

pressure regulating means disposed in a middle of the fuel supply line and located upstream of the fuel injecting means for regulating a pressure of the fuel flowing through the fuel supply line and for returning surplus fuel via the pressure regulating means into the fuel storing means;

a reflux pipe arrangement that is located downstream of the fuel injecting means and connected at one end to a downstream end of the fuel supply line and connected at the other end to the fuel storing means; and fluid-flow restriction orifice means constructed integral with the pressure regulating means and disposed in a middle of the reflux pipe arrangement for restricting a flow rate of the fuel flowing through the reflux pipe arrangement, wherein the fluid-flow restriction orifice controls a flow rate of the fuel flowing through the fluid-flow restriction orifice to a smaller value than a flow rate of the surplus fuel flowing through the pressure regulator to the fuel tank.

* * * * *